US009918561B2

(12) United States Patent
Perrin et al.

(10) Patent No.: US 9,918,561 B2
(45) **Date of Patent: *Mar. 20, 2018**

(54) ACCESS OPTIMIZED CHILD SUPPORT DEVICE

(71) Applicant: KIDS II, INC., Atlanta, GA (US)

(72) Inventors: Thomas M. Perrin, Alpharetta, GA (US); Stephen R. Burns, Cumming, GA (US); Chaitanya Tadipatri, Alpharetta, GA (US); Poon Yuk Tong, Yuen Long (HK)

(73) Assignee: KIDS II, INC., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/071,466

(22) Filed: Mar. 16, 2016

(65) Prior Publication Data

US 2016/0192787 A1 Jul. 7, 2016

Related U.S. Application Data

(63) Continuation-in-part of application No. 14/453,209, filed on Aug. 6, 2014, now Pat. No. 9,756,962.
(Continued)

(51) Int. Cl.
*A47B 39/00* (2006.01)
*A47B 83/02* (2006.01)
(Continued)

(52) U.S. Cl.
CPC ..... *A47D 1/006* (2013.01); *A47D 1/002* (2013.01); *A47D 1/004* (2013.01); *A47D 1/008* (2013.01); *A47D 1/02* (2013.01); *A47D 1/06* (2013.01); *A47D 1/10* (2013.01); *A47D 13/025* (2013.01); *A47D 13/107* (2013.01); *A47D 15/00* (2013.01); *A47D 1/04* (2013.01); *A47D 11/002* (2013.01)

(58) Field of Classification Search
CPC ..... A47D 1/008; A47D 11/002; A47D 1/04; A47D 1/006; A47D 1/06; A47D 1/002
USPC ..... 297/135, 281, 130, 118, 148, 152, 153, 297/154, 250.1, 256.13, 256.26
See application file for complete search history.

(56) References Cited

U.S. PATENT DOCUMENTS 704,774 A 7/1902 Blackledge
3,007,667 A 11/1961 Rossi
(Continued)

FOREIGN PATENT DOCUMENTS

CN 201312666 Y 9/2009
DE 202007005977 U1 8/2007
(Continued)

*Primary Examiner* — Chi Q Nguyen
(74) *Attorney, Agent, or Firm* — Gardner Groff Greenwald & Villanueva, PC

(57) ABSTRACT

A child support device including a folding frame having front legs and rear legs, and a hub pivotally coupling upper ends of the front and rear legs to move between a folded configuration and an unfolded configuration. The hub includes a first coupling element. The device further includes a support component having a second coupling element releasably engageable with the first coupling element, for detachably mounting the support component to the frame. The support component is optionally a dual-mode support, usable in a first mode of use mounted to the frame, and in a second mode of use independent of the frame.

28 Claims, 20 Drawing Sheets

Related U.S. Application Data

(60) Provisional application No. 61/864,156, filed on Aug. 9, 2013, provisional application No. 61/915,257, filed on Dec. 12, 2013, provisional application No. 62/135,498, filed on Mar. 19, 2015, provisional application No. 62/152,845, filed on Apr. 25, 2015, provisional application No. 62/215,784, filed on Sep. 9, 2015, provisional application No. 62/215,943, filed on Sep. 9, 2015.

(51) Int. Cl.

| | |
|---|---|
| ***A47D 1/00*** | (2006.01) |
| ***A47D 1/02*** | (2006.01) |
| ***A47D 1/06*** | (2006.01) |
| ***A47D 13/02*** | (2006.01) |
| ***A47D 15/00*** | (2006.01) |
| ***A47D 1/10*** | (2006.01) |
| ***A47D 13/10*** | (2006.01) |
| *A47D 11/00* | (2006.01) |
| *A47D 1/04* | (2006.01) |

(56) References Cited

U.S. PATENT DOCUMENTS 3,110,519 A 11/1963 Chernivsky
3,145,999 A 8/1964 Burnham
3,331,632 A 7/1967 Lerner
3,556,587 A 1/1971 Rymes
3,649,074 A 3/1972 McDonald et al.
3,653,080 A 4/1972 Hafele
3,759,539 A 9/1973 Goldberg
4,081,869 A 4/1978 Ash
4,141,095 A 2/1979 Adachi
4,188,678 A 2/1980 Rawolle
4,199,170 A * 4/1980 Hubner ..... B62B 5/0003 280/641
4,226,467 A 10/1980 Boudreau
4,359,045 A 11/1982 Cozzi
4,553,786 A 11/1985 Lockett, III et al.
4,685,688 A 8/1987 Edwards
4,718,715 A 1/1988 Ho
4,722,570 A 2/1988 Bertoli
4,747,526 A 5/1988 Launes
4,796,314 A 1/1989 Garduno
4,844,537 A 7/1989 Reed
4,946,180 A 8/1990 Baer
4,982,997 A 1/1991 Knoedler et al.
5,028,061 A 7/1991 Hawkes
5,050,862 A 9/1991 Saghafi
5,052,749 A 10/1991 Groenendijk
5,172,955 A 12/1992 Freese et al.
5,178,438 A 1/1993 Beger
5,203,611 A 4/1993 Greenwood
5,207,478 A 5/1993 Freese et al.
5,230,523 A 7/1993 Wilhelm
5,234,224 A 8/1993 Kim
5,238,292 A * 8/1993 Golenz ..... A47D 1/02 297/149
5,265,931 A 11/1993 Ryan
5,269,591 A 12/1993 Miga, Jr. et al.
5,308,143 A 5/1994 Cheng et al.
5,342,113 A 8/1994 Wu
5,360,258 A 11/1994 Alivizatos
5,364,137 A 11/1994 Shimer
5,451,095 A 9/1995 Riback
5,460,430 A 10/1995 Miga, Jr. et al.
5,470,039 A 11/1995 Hilger
5,503,458 A 4/1996 Petrie
5,507,564 A 4/1996 Huang
5,509,721 A 4/1996 Huang
5,527,096 A 6/1996 Shimer
5,564,778 A 10/1996 Shimer et al.
5,575,530 A 11/1996 Harper et al.
5,615,428 A 4/1997 Li
5,636,853 A 6/1997 Huang
5,694,655 A 12/1997 Shepler et al.
5,707,104 A 1/1998 Perego
5,762,310 A 6/1998 Schill
5,772,279 A * 6/1998 Johnson, Jr. ..... B60N 2/2821 280/30
5,863,097 A 1/1999 Harper et al.
5,887,945 A 3/1999 Sedlack
5,934,641 A 8/1999 Vince
5,947,552 A 9/1999 Wilkins et al.
5,951,102 A 9/1999 Poulson et al.
6,070,890 A 6/2000 Haut et al.
6,089,653 A * 7/2000 Hotaling ..... A47D 1/002 297/130
6,129,414 A 10/2000 Brevi
6,174,028 B1 1/2001 Yang et al.
6,257,659 B1 7/2001 Wilkins et al.
6,290,290 B1 9/2001 Kokuzian et al.
6,318,807 B1 * 11/2001 Perego ..... B62B 7/142 297/130
6,341,816 B1 1/2002 Chen et al.
6,361,106 B1 3/2002 Huang
6,378,940 B1 4/2002 Longoria et al.
6,390,555 B2 5/2002 Wilkins et al.
6,431,646 B1 8/2002 Longoria
6,539,563 B1 4/2003 Hsia
6,540,292 B2 4/2003 Darling et al.
6,547,195 B1 4/2003 Kokuzian et al.
6,574,806 B1 6/2003 Maher
6,588,033 B1 * 7/2003 Welsh, Jr. ..... A47D 7/002 5/93.1
6,594,840 B2 7/2003 Tomas et al.
6,616,237 B2 9/2003 Sonner et al.
6,645,080 B1 11/2003 Greger et al.
6,679,779 B2 1/2004 Tai et al.
6,682,137 B2 1/2004 Hsia
6,682,148 B1 1/2004 Chen
6,687,928 B1 2/2004 Wilson
6,719,371 B2 * 4/2004 Yoshie ..... A47D 1/002 297/344.14
6,739,649 B2 5/2004 Kelly et al.
6,851,745 B2 2/2005 nee Wilkins et al.
6,857,966 B2 2/2005 Armbruster et al.
6,877,802 B2 4/2005 Christensen et al.
6,896,624 B2 5/2005 Longenecker et al.
6,902,489 B2 6/2005 Greger et al.
6,951,371 B2 10/2005 Wang
7,017,924 B1 3/2006 Lambert
7,029,064 B2 4/2006 Chen
7,052,403 B2 5/2006 Ransil et al.
7,066,542 B2 6/2006 Wang
7,255,393 B2 8/2007 Flanagan
D560,374 S 1/2008 Bergkvist
7,326,120 B2 2/2008 Bellows et al.
7,334,836 B2 2/2008 Chen
7,422,524 B2 9/2008 Gregorian
7,445,559 B2 11/2008 Kakuda
7,455,353 B2 11/2008 Favorito (nee Wilkins) et al.
7,543,886 B2 6/2009 Gutierrez-Hedges et al.
7,555,791 B1 7/2009 Pereira
7,568,758 B2 8/2009 Troutman et al.
7,651,168 B2 1/2010 Kelly
7,673,934 B2 3/2010 Bearup et al.
7,694,362 B2 4/2010 Gudipati
7,695,374 B2 4/2010 Bellows et al.
7,779,490 B2 8/2010 Bergkvist
7,780,236 B2 8/2010 Bergkvist
7,810,885 B2 10/2010 Chen et al.
7,862,118 B2 1/2011 Sims, Jr.
7,878,915 B2 2/2011 Myers et al.
7,891,736 B2 2/2011 Sims, Jr.
7,896,431 B2 3/2011 Cui et al.
7,905,549 B2 3/2011 Lake et al.
7,918,497 B2 4/2011 Keegan
8,011,722 B2 9/2011 Cui et al.
8,038,207 B2 10/2011 Flannery
8,141,943 B2 3/2012 Hu et al.
8,205,943 B2 6/2012 Zhong

(56) References Cited

U.S. PATENT DOCUMENTS

| | | | | |
|---|---|---|---|---|
| 8,382,203 | B2 | 2/2013 | Gilbert et al. | |
| 8,419,132 | B2 | 4/2013 | Jacobs | |
| 8,454,049 | B2 | 6/2013 | Chen et al. | |
| 8,544,949 | B2 | 10/2013 | Taton | |
| 8,550,556 | B2 | 10/2013 | Asbach | |
| D692,680 | S | 11/2013 | Bergkvist et al. | |
| 8,668,273 | B2 | 3/2014 | Wang | |
| 8,672,341 | B2 | 3/2014 | Offord | |
| 8,690,245 | B2 | 4/2014 | Tuckey | |
| 8,740,306 | B2 | 6/2014 | Tuckey et al. | |
| 8,746,794 | B2 | 6/2014 | Oren et al. | |
| 8,757,716 | B2 | 6/2014 | Ru et al. | |
| 8,770,660 | B2 | 7/2014 | Chen et al. | |
| 8,783,769 | B2 | 7/2014 | Gilbert et al. | |
| 8,844,072 | B2 | 9/2014 | Bellows et al. | |
| 8,845,028 | B2 | 9/2014 | Miller | |
| 8,893,326 | B2 | 11/2014 | Gooris | |
| 8,919,871 | B2 | 12/2014 | Huntsberger et al. | |
| 8,991,920 | B2 | 3/2015 | Oren et al. | |
| 9,055,847 | B1 | 6/2015 | Flannery et al. | |
| 9,066,604 | B2 | 6/2015 | Chen | |
| 9,102,348 | B2 | 8/2015 | Miller et al. | |
| 9,127,709 | B2 | 9/2015 | Shan | |
| 9,138,070 | B1 | 9/2015 | Shamie et al. | |
| 9,200,746 | B2 | 12/2015 | Xiao | |
| 9,279,486 | B2 | 3/2016 | Wu | |
| 2001/0013689 | A1* | 8/2001 | Cone, II | B62B 9/28 280/47.41 |
| 2003/0020317 | A1 | 1/2003 | Keegan et al. | |
| 2004/0026976 | A1 | 2/2004 | Chen et al. | |
| 2005/0011004 | A1 | 1/2005 | Favorito (nee Wilkins) et al. | |
| 2005/0054486 | A1 | 3/2005 | Turner et al. | |
| 2005/0241064 | A1 | 11/2005 | Lopes et al. | |
| 2006/0103178 | A1 | 5/2006 | Wun | |
| 2006/0181123 | A1 | 8/2006 | Gibree | |
| 2007/0007804 | A1 | 1/2007 | Pemberton et al. | |
| 2007/0029847 | A1* | 2/2007 | Finell | A47C 7/004 297/148 |
| 2007/0049390 | A1 | 3/2007 | Wu et al. | |
| 2008/0001450 | A1 | 1/2008 | Yang | |
| 2009/0200846 | A1 | 8/2009 | Yehuda | |
| 2009/0206637 | A1 | 8/2009 | Lo | |
| 2011/0127810 | A1 | 6/2011 | Lee et al. | |
| 2011/0148155 | A1 | 6/2011 | Chapman et al. | |
| 2011/0227275 | A1* | 9/2011 | Poh | B65H 3/047 271/18.1 |
| 2011/0227384 | A1* | 9/2011 | Huntsberger | A47D 1/10 297/250.1 |
| 2011/0260507 | A1 | 10/2011 | Parness et al. | |
| 2012/0036635 | A1 | 2/2012 | Lapointe | |
| 2012/0169097 | A1 | 7/2012 | Mendes | |
| 2012/0261962 | A1 | 10/2012 | Huntsberger et al. | |
| 2013/0214574 | A1 | 8/2013 | Chapman et al. | |
| 2013/0326817 | A1 | 12/2013 | Moulin | |
| 2014/0075671 | A1 | 3/2014 | Haut et al. | |
| 2014/0215712 | A1 | 8/2014 | Xu et al. | |
| 2014/0215714 | A1 | 8/2014 | Xu et al. | |
| 2014/0306498 | A1 | 10/2014 | Gilbert et al. | |
| 2014/0366276 | A1 | 12/2014 | Chang et al. | |
| 2014/0368014 | A1 | 12/2014 | Haut et al. | |
| 2015/0015036 | A1 | 1/2015 | Soriano | |
| 2015/0042130 | A1 | 2/2015 | Perrin et al. | |
| 2015/0289676 | A1 | 10/2015 | Huntsberger et al. | |
| 2015/0289677 | A1 | 10/2015 | Huntsberger et al. | |
| 2015/0289678 | A1 | 10/2015 | Vinje Brustad et al. | |
| 2015/0342365 | A1 | 12/2015 | Corso et al. | |
| 2015/0342366 | A1 | 12/2015 | Xu et al. | |
| 2015/0342367 | A1 | 12/2015 | Corso et al. | |

FOREIGN PATENT DOCUMENTS

| | | | |
|---|---|---|---|
| DE | 102007014995 | A1 | 10/2008 |
| DE | 102009034552 | B3 | 2/2011 |
| GB | 2449999 | A | 12/2008 |
| WO | 2006130906 | A1 | 12/2006 |
| WO | 2007112883 | A2 | 10/2007 |

* cited by examiner

FIG. 18
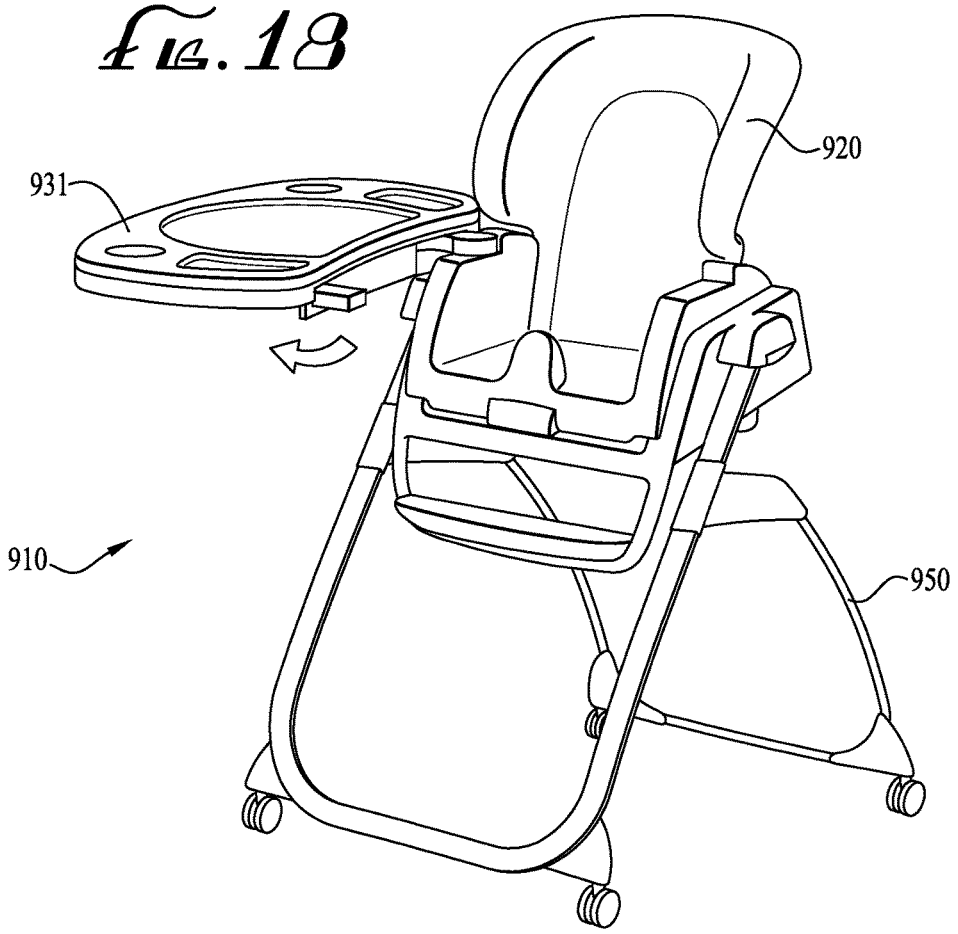
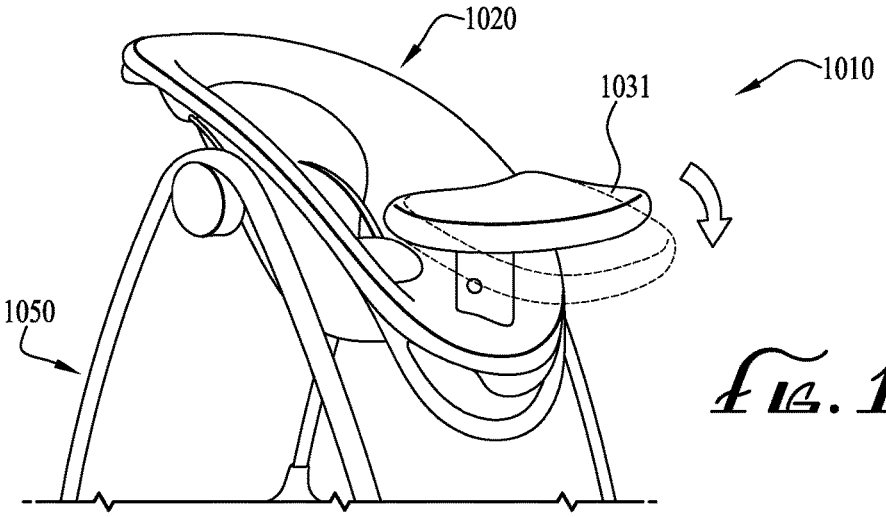
FIG. 19

ACCESS OPTIMIZED CHILD SUPPORT DEVICE

CROSS-REFERENCE TO RELATED APPLICATIONS

This application is a continuation-in-part of U.S. patent application Ser. No. 14/453,209 filed Aug. 6, 2014, which claims priority to U.S. Provisional Patent Application Ser. No. 61/864,156 filed Aug. 9, 2013 and U.S. Provisional Patent Application Ser. No. 61/915,257 filed Dec. 12, 2013; and this application also claims priority benefit of U.S. Provisional Patent Application Ser. No. 62/135,498 filed Mar. 19, 2015, U.S. Provisional Patent Application Ser. No. 62/152,845 filed Apr. 25, 2015, U.S. Provisional Patent Application Ser. No. 62/215,784 filed Sep. 9, 2015 and U.S. Provisional Patent Application Ser. No. 62/215,943 filed Sep. 9, 2015; and the entireties of all of these applications are hereby incorporated herein by reference.

TECHNICAL FIELD

The present invention relates generally to the field of infant and child accessories, and more particularly to a mobile device for supporting and moving an infant or child, which is optimized for access to and interaction with the infant or child by a parent or caregiver.

BACKGROUND

Various accessories are used for supporting and transporting infants and children for different purposes. For example, a high-chair may be used for feeding or seating a child who can sit up, a bassinet or carrier may be used to support a laying or reclining infant or child, and a stroller may be used to transport a child from one location to another. None of these known accessories, however, allows optimal access to and interaction with an infant or child supported therein.

For example, a high-chair may not be well suited for a child who has not yet grown strong enough to sit up. High chairs also typically provide a seating height that is too high for interaction with the child by a caregiver seated on a sofa or other adult furniture. The mobility and maneuverability of high-chairs is typically limited at best. And the feeding tray, support frame and/or other components of a high-chair may interfere with positioning the infant or child in close proximity to a caregiver seated on a sofa or other adult furniture, and limit access to and interaction with the infant by the caregiver.

Conversely, the support height of known bassinets and carriers is commonly too low for ease of interaction with and access to the child by a caregiver seated on a sofa or other adult furniture, or when seated at a table for dining. The mobility and maneuverability of bassinets and carriers is also typically limited at best. And the support frame, carrier handles, and/or other components of a bassinet or carrier may interfere with positioning the infant or child in close proximity to a caregiver seated on a sofa or other adult furniture, and limit access to and interaction with the infant by the caregiver.

Strollers also typically position an infant or child too low for ease of interaction with and access to the child by a caregiver seated on a sofa or other adult furniture, or when seated at a table for dining. The mobility and maneuverability of strollers is typically best for outside use or use in open interior areas, but may not be good for moving an infant or child inside a home or other interior space where closely spaced furniture and narrow doorways and halls can interfere with movement and turning of a stroller. Stroller handles and support frames, large wheel assemblies, feeding trays and other components of a stroller may also interfere with positioning the infant or child in close proximity to a caregiver seated on a sofa or other adult furniture, and limit access to and interaction with the infant by a caregiver.

Additionally, known children support devices such as bouncers and rockers are typically adapted to rest on a low support surface such as a floor. Because the child is supported mere inches above the ground, he or she is out of direct line of sight of a caregiver who is seated in a chair or standing.

Accordingly, it has been discovered that needs exist for a mobile device for supporting and moving an infant or child, which is optimized for access to and interaction with the infant or child by a parent or caregiver, particularly for example, inside a home or other interior space. A need further exists for an improved infant support device that comprises a seat and an elevated support base, which can be moved from room to room within a home. It is to the provision of a mobile device for supporting and moving an infant or child meeting these and other needs that the present invention is primarily directed.

SUMMARY

In example embodiments, the present invention provides a mobile device for supporting and moving an infant or child, which is optimized for access to and interaction with the infant or child by a parent or caregiver, particularly for example, inside a home or other interior space. The configuration of example embodiments of the support and transport device of the present invention allows parents or caregivers to position their infant or child in close proximity, for example when seated on a sofa, easy chair or other adult furniture, or when seated at a table for dining. The configuration of example embodiments of the support and transport device of the present invention also enables ease of mobility and maneuverability inside a home or other interior space where closely spaced furniture and narrow doorways can interfere with movement and turning of other devices.

In one aspect, the present invention relates to a child support device including a folding frame having front legs and rear legs, the front and rear legs pivotally coupled to one another to move between a folded configuration and an unfolded configuration, and further including a support component mounted to the frame having a receiving area for receiving and supporting a child, wherein frame supports the support component with the receiving area positioned at a height of about 21" to about 36" above a support surface.

In another aspect, the invention relates to a child support device including a frame having front legs and rear legs, and a hub connecting the front and rear legs, the hub including a first coupling element, and further including a support component having a second coupling element for detachably mounting the support component to the frame, wherein the frame supports the support component at a height of about 21" to about 36" above a support surface.

In still another aspect, the invention relates to a child support device including a folding frame having front legs and rear legs, and a hub pivotally coupling upper ends of the front and rear legs to move between a folded configuration and an unfolded configuration. The hub includes a first coupling element. The device further includes a support component having a second coupling element releasably engageable with the first coupling element, for detachably mounting the support component to the frame. The support component is optionally a dual-mode support, usable in a first mode of use mounted to the frame, and in a second mode of use independent of the frame In another aspect, the invention relates to support devices for children, and more particularly to an infant seat configured to optionally engage a support frame.

In another aspect, the invention relates to an access-optimized infant support device comprising a lower support frame, and a seat or resting portion supported on the lower support frame, whereby the lower support frame maintains the seat or resting portion above a support surface, and the seat or resting portion can be optionally detached from the lower support frame to rest directly on a support surface.

In another aspect, the invention relates to an infant seat comprising a child receiving portion having a primary base adapted to allow a rocking or bouncing motion on a support surface, and a secondary base adapted to receive the child receiving portion at an elevated height.

In another aspect, the invention relates to a mobile device for supporting and moving an infant or child, the device comprising a seat portion having a seat frame adapted to rest and reciprocally move on a support surface. The device further includes a support frame for supporting the seat portion above a support surface, the support frame comprising one or more support legs, the support legs generally extending from a proximal end near the seat portion to a distal end opposite the seat portion.

In another aspect, the invention relates to a child support device including a seat adapted to receive an infant or child and a support frame configured to support the seat above a support surface (e.g., a floor). In another aspect, the seat is configured to move with respect to the support frame and to impart a soothing motion to a child occupant. In another aspect, the seat can be selectively oriented in a reclined position and an inclined position.

In another aspect, the invention relates to a child support device comprising a support frame; and a seat movably mounted to the support frame. In another aspect, the invention relates to a child support device comprising a support frame configured to rest on a support surface; and a seat adapted to receive a child and supported by the support frame above the support surface; wherein the seat is configured for movement relative to the support frame.

In another aspect, the present invention relates to an access-optimized infant support device comprising a lower support frame and a seat or resting portion supported on the lower support frame, whereby the lower support frame maintains the seat or resting portion at a height of about 21" to about 36" above a support surface. In one aspect the seat or resting portion is maintained at a height of about 29".

In another aspect, the invention relates to an access-optimized infant support device comprising a lower support frame and a seat or resting portion supported on the lower support frame, wherein the seat or resting portion is oriented at an angle of inclination of about 15° to about 40°.

In still another aspect, the invention relates to an access-optimized infant support device comprising a lower support frame, a seat or resting portion supported on the lower support frame, and a gripping handle comprising a wrap-around halo grip substantially surrounding the seat or resting portion.

In another aspect, the invention relates to a mobile device for supporting and moving an infant or child including a seat portion and a support frame. The support frame supports the seat portion and includes one or more support legs and one or more cross-members extending between the support legs. The support legs generally extend from a proximal end near the seat portion to a distal end near a support surface or other ground surface that is supporting the frame. In one form, the distal ends of the support frame define a periphery including a width (W) and a length (L). In particular example embodiments, the width is between about 14" to about 23" and the length is between about 19" to about 31", and a length-to-width aspect ratio (L/W) is between about 0.8 to about 2.2.

In still another aspect, the invention relates to a mobile infant support device including a seat or resting portion for supporting a child or infant and a support frame for supporting the seat or resting portion about a support surface. In example forms, the support frame maintains the seat or resting portion at a height relative to the support surface such that a line-of-sight contact interaction between the infant on the seat or resting portion and an adult seated at a standard dining table or sofa can be easily maintained.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of preferred embodiments of the invention, and are not restrictive of the invention, as claimed.

BRIEF DESCRIPTION OF THE DRAWINGS

FIG. 18 is a perspective view of a support device incorporating a horizontally pivotal tray according to another example embodiment of the invention.

FIG. 19 is a perspective view of a support device incorporating a vertically pivotal tray according to another example embodiment of the invention.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
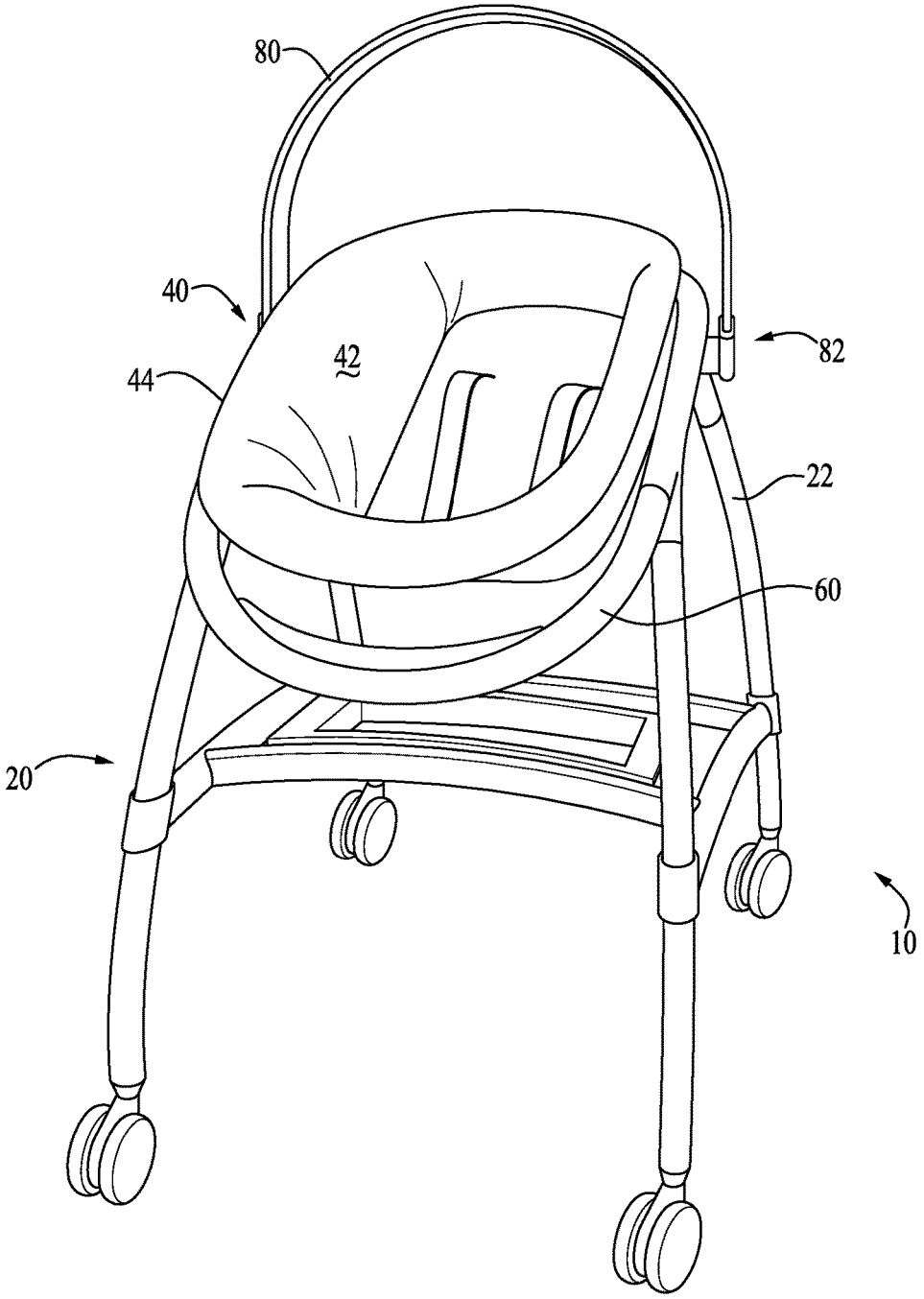
FIG. 1 is a front perspective view of a mobile device for supporting and moving an infant or child according to an example embodiment of the present invention.
Figure 2:
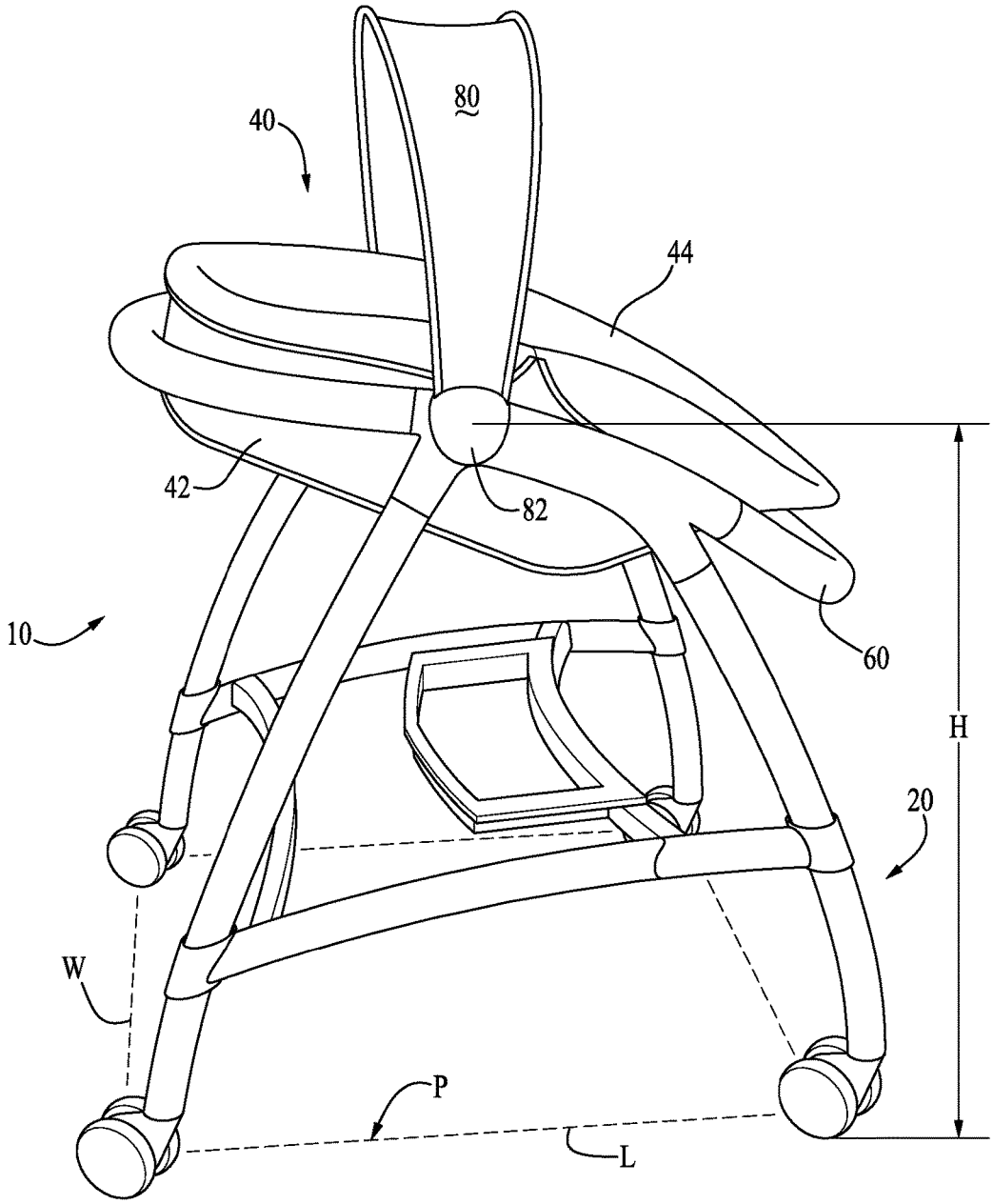
FIG. 2 is a side perspective view of the mobile device for supporting and moving an infant or child shown in FIG. 1.
Figure 3:
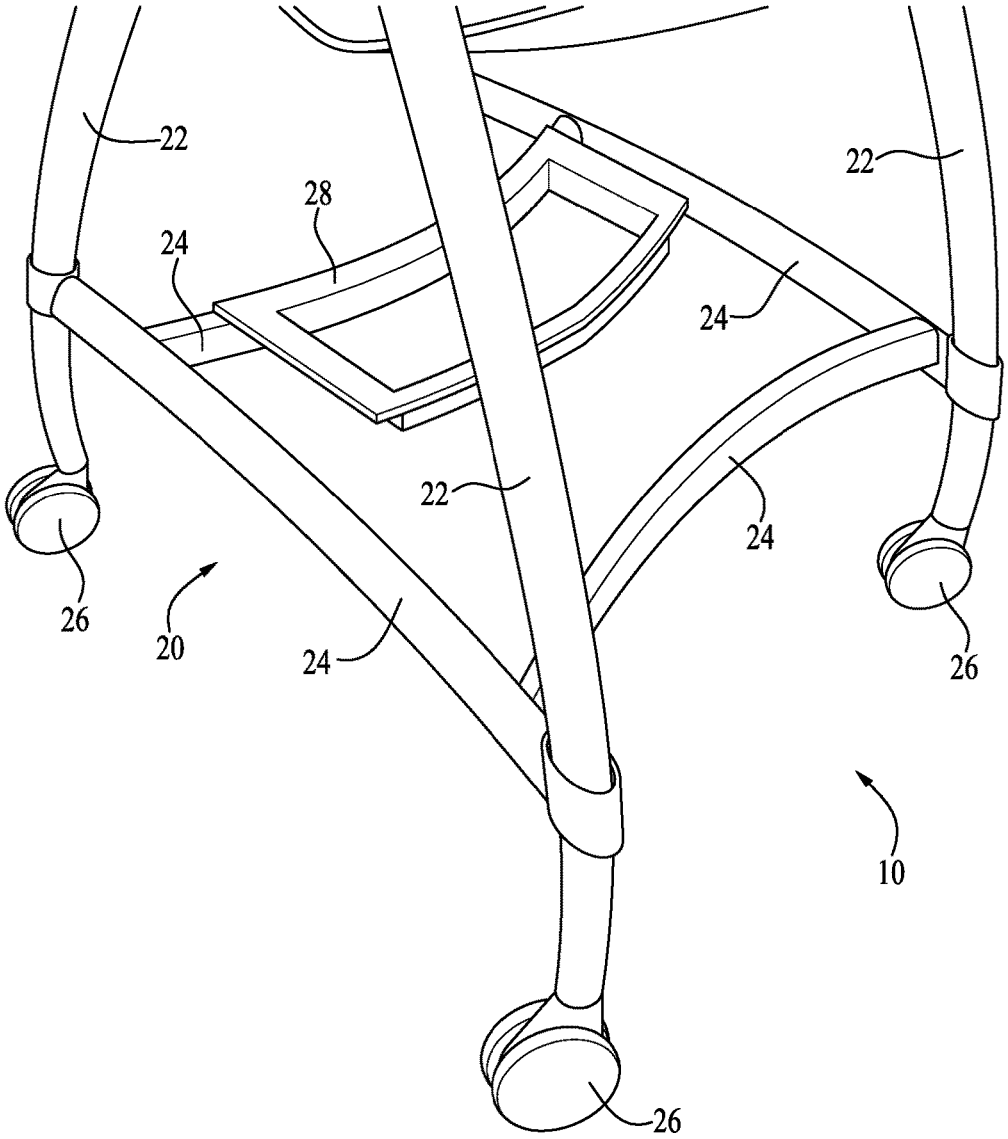
FIG. 3 is a detailed view of a lower support frame portion of the mobile device for supporting and moving an infant or child shown in FIG. 1.

With reference now to the drawing figures, wherein like reference numbers represent corresponding parts throughout the several views, FIGS. 1-3 show a mobile device 10 for supporting and moving an infant or child, according to an example embodiment of the invention. The device 10 generally comprises a support frame 20 and a seat or resting portion 40 supported on the support frame. The seat or resting portion 40 can be coupled directly to the support frame 20, or can be indirectly coupled to the frame by one or more intermediate couplings, linkages or connection members. Optionally, at least some degree of freedom of movement is provided between the seat or resting portion 40 and the support frame 20, for example allowing a rocking, jiggle, bounce, swing or other range of motion of the seat or resting portion relative to the support frame and underlying support surface. In example forms, the mobile support device is configured for use with zero to six month old infants, where access by, proximity to and interaction with a parent or other adult caregiver is most frequently needed, but in alternate forms may be adapted to other uses.

The support frame 20 preferably comprises one or more (four in the depicted embodiment) support legs or columns 22 for providing structural support to hold the seat or resting portion 40 at an elevation above the floor or other support surface. One or more cross-members or braces 24 extend between the legs 22 and/or between other braces. Wheels or rollers 26 mounted to distal or lower ends of the legs 22 allow for ease of mobility of the mobile support device 10 along the floor or other support surface. Optionally the wheels 26 comprise caster wheels or otherwise pivot or turn to provide ease of maneuverability. In example forms, the diameter of the wheels 26 is between about 2.5"-5", more preferably between about 3"-4", for example about 3.5". The frame 20 is optionally foldable or collapsible for compact storage and transport, for example by means of one or more hinged connections, pins, snap buttons, or other connection or coupling means. A storage tray 28 or other container or compartment for holding toys or other items is optionally mounted to a cross-member 24 or otherwise attached to the frame 20.

In example embodiments, the distal or lower ends of the legs 22 of the support frame 20 define an outline or periphery P along the floor or other support surface, as shown in broken lines in FIG. 2, within the upward projection of which the mobile support device 10 is substantially or entirely contained. In the depicted embodiment, the periphery P is generally rectangular or square in profile, being defined about four legs 22, but in alternate embodiments may be for example triangular, polygonal or circular in profile depending on the number and configuration of the legs of the support frame. In example embodiments, the periphery P is between about 14"-23" wide, preferably between about 16"-20" wide, and for example about 18" wide in width (W), by between about 19"-31", preferably between about 22"-28", and for example about 25" long in length (L), for example about 18"×25", defining a length-to-width aspect ratio (L/W) of between about 0.8-2.2, preferably between about 1.1-1.8, and for example about 1.4. Optionally, the legs 22 are generally arcuate, such that their lower or distal portions are more vertically oriented and their upper or proximal portions curve to a more horizontal or oblique angle, with the curvature being convex or outwardly directed. The cross-braces 24 are optionally inset from an upward projection of the periphery P, for example by providing them with an inward or concave curvature and/or by attachment inwardly of the support legs 22, as seen best with reference to FIG. 3. In this manner, the mobile support device 10 can be positioned in close proximity to a caregiver seated on furniture, without the support frame 20 interfering with movement and positioning of the device.

In example embodiments, the seat or resting portion 40 comprises a fabric or soft-goods sling 42, forming a reclined seat or bassinet for comfortably receiving an infant or child, mounted to a seat frame 44. The sling 42 optionally comprises structural bracing and/or padding for improved comfort and positioning. One or more straps or harness connections are optionally provided to secure the child in the sling 42. The sling 42 and/or the seat frame 44 are optionally repositionable to allow adjustment of the inclination, elevation or other positioning of the seat or resting portion 40, for example by means of a cinch cord or strap, snap couplings, pivotal connection, or other positional adjustment means. In example embodiments, the seat or resting portion 40 is positioned or positionable at an angle of inclination of between about 15°-40° from horizontal, for example about 27.5° relative to the horizontal.

The mobile support device 10 preferably further comprises a multi-point accessible handle 60 having a plurality of gripping or contact surfaces positioned at different points about the seat or resting portion 40. In example embodiments, the handle 60 provides access for gripping adjacent at least two of the head end, foot end, left side and/or right side of the seat or resting portion 40, and more preferably from three or all four sides thereof. In the depicted embodiment, the handle 60 comprises oval or elliptically shaped wrap-around or perimeter handle or gripping halo extending about all or a substantial portion of the seat or resting portion 40. In this manner, the handle can be gripped to push or pull the device 10 from any position for improved mobility and maneuverability. Provision of a wrap-around handle or halo as in the depicted embodiment allows the handle to serve the additional function of a protective bumper about the seat or resting portion 40 of the mobile support device 10. The handle 60 is preferably positioned adjacent or in close proximity below the upper rim of the seat or resting portion 40 formed by the seat frame 44, and closely or generally conforms to the peripheral profile of the seat frame. In example embodiments, the wrap-around handle 60 defines an upper support frame portion that generally aligns with the upward projection of the periphery P of the lower support frame 20. In alternate embodiments, the wrap-around handle 60 may be offset from the projection of periphery P of the lower support frame 20; either inwardly offset relative to the lower support frame for improved stability, or outwardly offset for improved access and proximity to the infant by an adult caregiver when the lower support frame is positioned against a sofa or other furniture.

In example embodiments, the handle 60 is coupled to the support frame 20, and the seat frame 44 is suspended from or otherwise coupled to the handle. A hinge connection, one or more springs, or other articulation means operably connected between the seat frame 44 and the handle 60 or the support frame 20 optionally allows movement of the seat or resting portion 40 relative to the support frame, for soothing or engaging an infant or child positioned in the mobile support device 10. In example embodiments, the seat 40 may jiggle, rock, swing, bounce or otherwise move. A motorized or manually energized movement mechanism is optionally provided. A pivotal coupling is optionally provided between the support frame 20 and the handle 60 to allow adjustment of the inclination of the seat 40. An upper member 80, such as a canopy, toy bar or handle is optionally attached over the seat 40, for example by pivotal or fixed attachment to a multi-connection hub or mounting member 82 coupling with the support frame 20 and/or the handle 60. Optionally, a vibration unit can be coupled to the support frame 20 or seat frame 44 for soothing the infant or child positioned in the mobile support device 10.

In example embodiments, the mobile support device is configured to position the infant or child at an elevation or height and/or at an orientation that is optimized for access, proximity and interaction with an adult caregiver in various situations, for example while the caregiver is standing, walking, seated at a table for dining, or seated in a sofa, easy chair or other adult furniture. For example, the nominal or median height (H) of the seat or resting portion 40 may be positioned at about 21"-36" above the floor, and more preferably at a height of about 26"-32", for example about 29" high; thereby, for example, defining a height-to-width (H/W) aspect ratio of between about 0.9-2.6, preferably between about 1.3-2.0, and for example about 1.6; and a length-to-width (L/W) aspect ratio of between about 0.8-2.2, preferably between about 1.1-1.8, and for example about 1.4. Optionally, the height of the seat or resting portion 40 may be adjustable. In example embodiments, the wrap-around handle 60 may be inclined at an oblique angle of for example about 15°-40°, for example about 27.5° relative to the horizontal or have a staggered profile along its length, whereby a lower portion at the foot end of the seat 40 is positioned lower than the nominal or median height (H) of the seat, thus providing a convenient gripping position for the caregiver when seated; and an upper portion at the head end of the seat is positioned higher than the nominal or median height, thus providing a convenient gripping position for the caregiver when standing or walking. In example embodiments, the elevation of the handle at the foot end is between about 13"-22" high, preferably between about 16"-19" in height, and for example about 17.5" above the floor; and the elevation of the handle at the head end is between about 22"-38" high, preferably between about 27"-33" in height, and for example about 30" above the floor. In this manner the height of the seat or resting portion allows a line-of-sight eye-contact interaction between an infant on the seat or resting portion and an adult seated at a standard dining table, and also allows close proximity between the infant on the seat or resting portion and an adult seated on a standard sofa. For example, the mobile support device may be positioned adjacent a standard sofa with the infant being within 12"-36", and preferably within 24" or less, from the adult; and/or the line of sight between the infant's eye-level and the adult's eye level is between about 0°-30°, preferably 15° or less, relative to horizontal, when the infant is positioned about 48"-60" from the adult at a dining table.

Figure 4A:
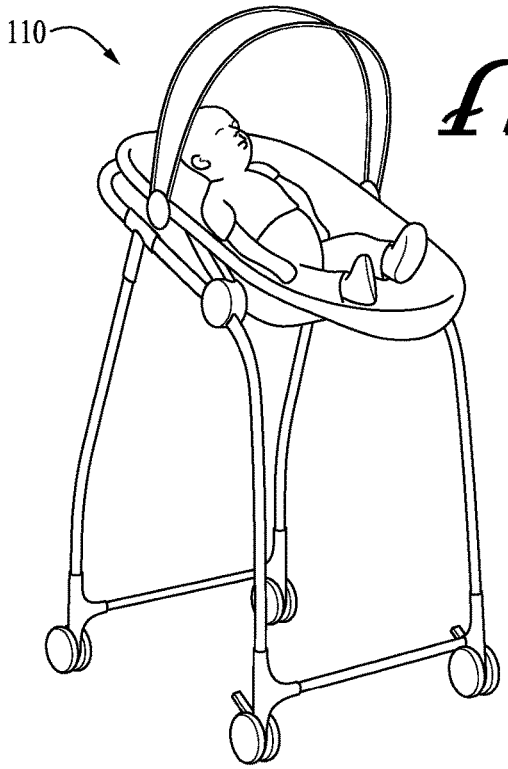
FIGS. 4A-4F show additional example embodiments of a mobile device for supporting and moving an infant or child according to the present invention.
Figure 4B:
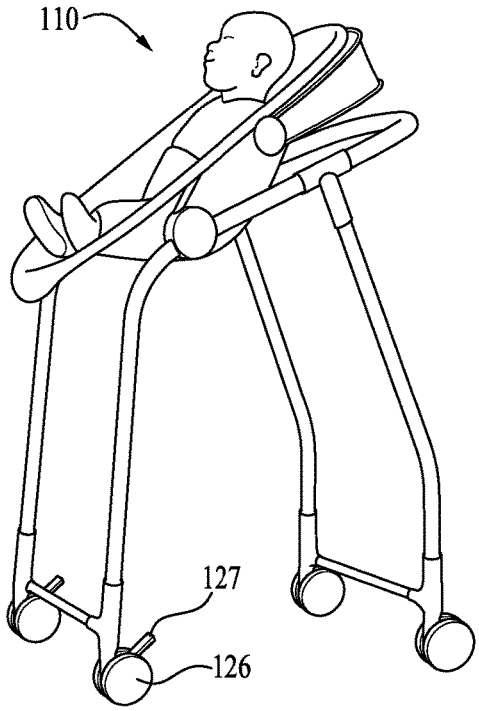
Figure 4C:
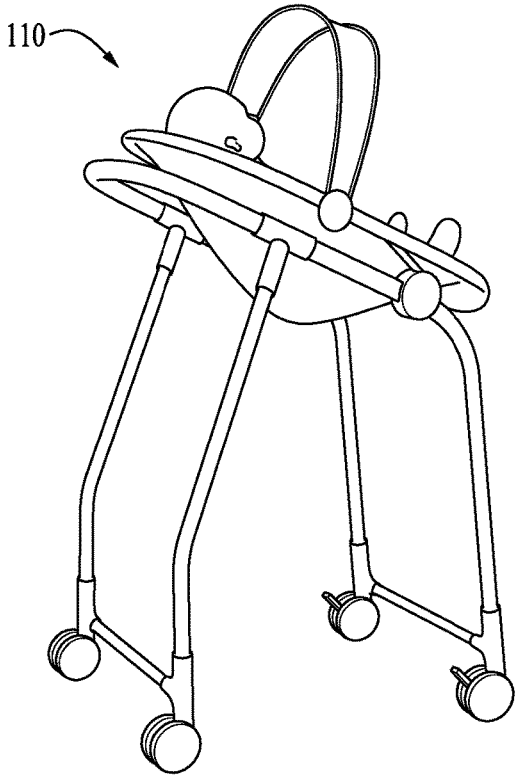
Figure 4D:
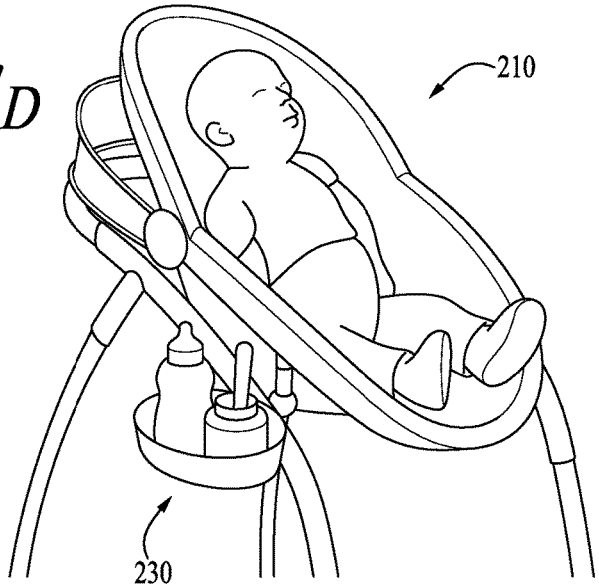
Figure 4E:
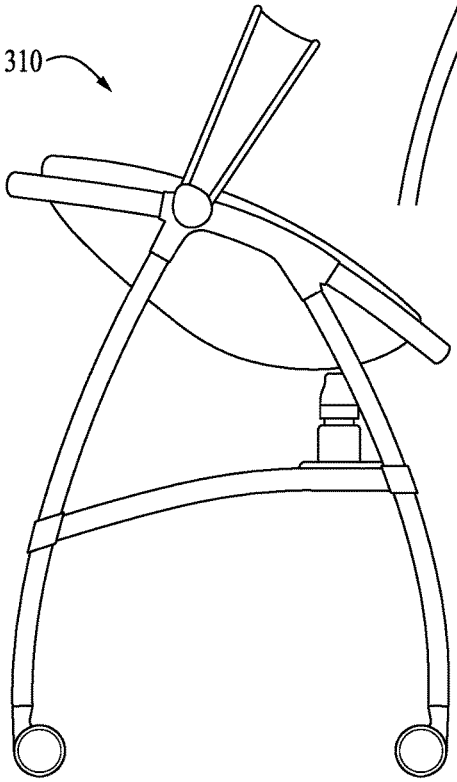
Figure 4F:
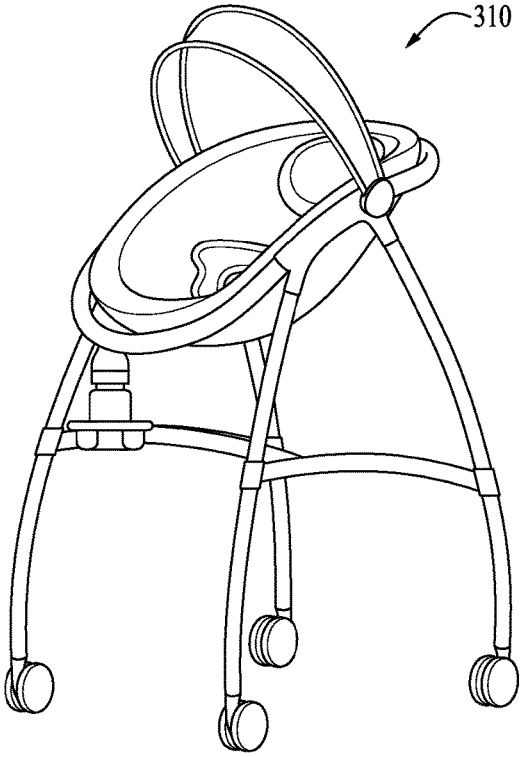

FIGS. 4A-4C show one alternate embodiment of a mobile support device 110, FIG. 4D shows another alternate embodiment of a mobile support device 210, and FIGS. 4E and 4F show still another alternate embodiment of a mobile support device 310, according to various forms of the invention. In its various forms, the child support device comprises a frame configured to rest on a support surface and a seat coupled to the frame and adapted for receiving an infant. Preferably, the support device includes one or more wheel assemblies, or other rolling/sliding means, which allow the support device to be rolled across the support surface. Example embodiments of the wheel assemblies can include a locking mechanism to selectively prohibit rolling of the child support device. The wheel assemblies can also or alternatively include a braking mechanism that engages in the event of accidental rolling. For example, one or more of the wheel assemblies 126 of the movable support device 110 can comprise a brake 127 for selectively engaging to prevent rotation of the wheel to resist movement of the device, or disengaging to release the wheel and allow movement of the device. A handle can also be included to facilitate a caregiver pushing or pulling the support device from room to room. Example embodiments of the handle are movable between various positions, such as above, behind, or in front of the seat. The seat can be coupled to the frame by way of one or more resilient members, such as springs or compliant wires that allow the seat to bounce or jiggle with respect to the frame. This bouncing motion can be soothing to children, and the resilient suspension can soften the jarring effect of any bumps as the support device is wheeled from place to place. Example embodiments of the seat can also be selectively reclined with respect to the support surface, either via adjustable soft-goods or by a mechanical recline adjustment mechanism. Moreover, various accessories can be attached to the child support device, such as a vibration unit, a tray, and/or a storage bin. The support device can further be configured to collapse for easy storage and transport.

In further alternate embodiments, the seat or resting portion is optionally detachable and removable from a coupling or receiver of the lower support frame. In this manner, the lower support frame can provide a docking station for one or more interchangeable seat, carrier, support, changing table or other accessories that can be selectively attached to and removed from the coupling of the lower support frame.

For improved mobility of the device and accessibility to the infant or child, example embodiments of the mobile support device according to the present invention do not include any feeding tray, push-handle or other components as are commonly included on high-chairs or strollers, or at least do not include such components in a position or configuration extending substantially beyond the upward projection of the periphery of the device's support frame where they could interfere with mobility, maneuverability, access, proximity or interaction with the infant. Optionally, as depicted in FIG. 4D, a tray 230 may project outwardly from the upper portion of the support frame 220 at least partially beyond the upward projection of the periphery of the support frame, but is preferably positioned so as not to interfere with mobility, maneuverability, access, proximity or interaction with the infant.

Figure 6:
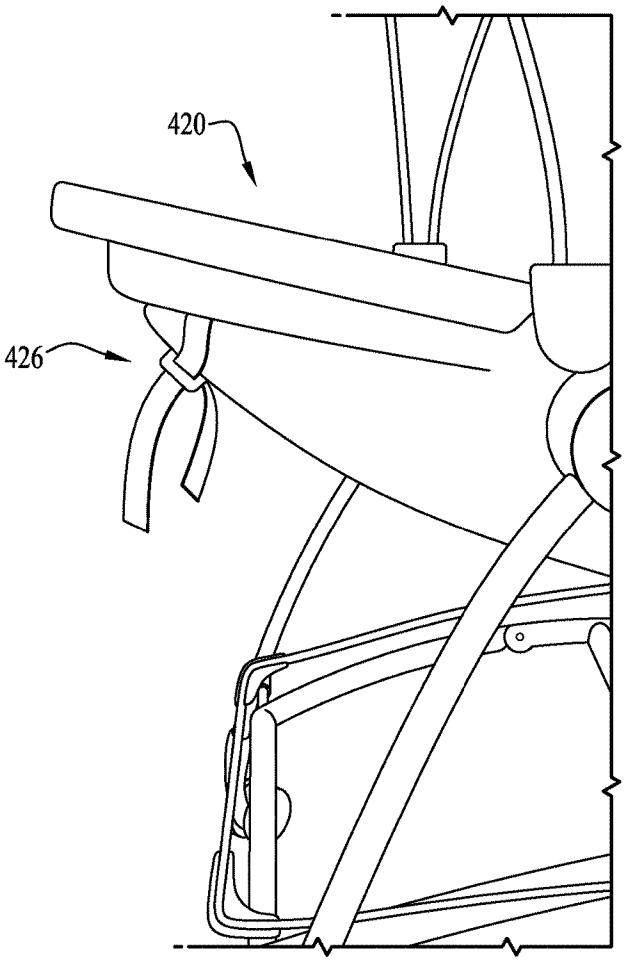
FIG. 6 shows additional detail of a seat incline-recline positional adjustment mechanism of the support device of FIG. 5, according to an example embodiment of the invention.
Figure 5:
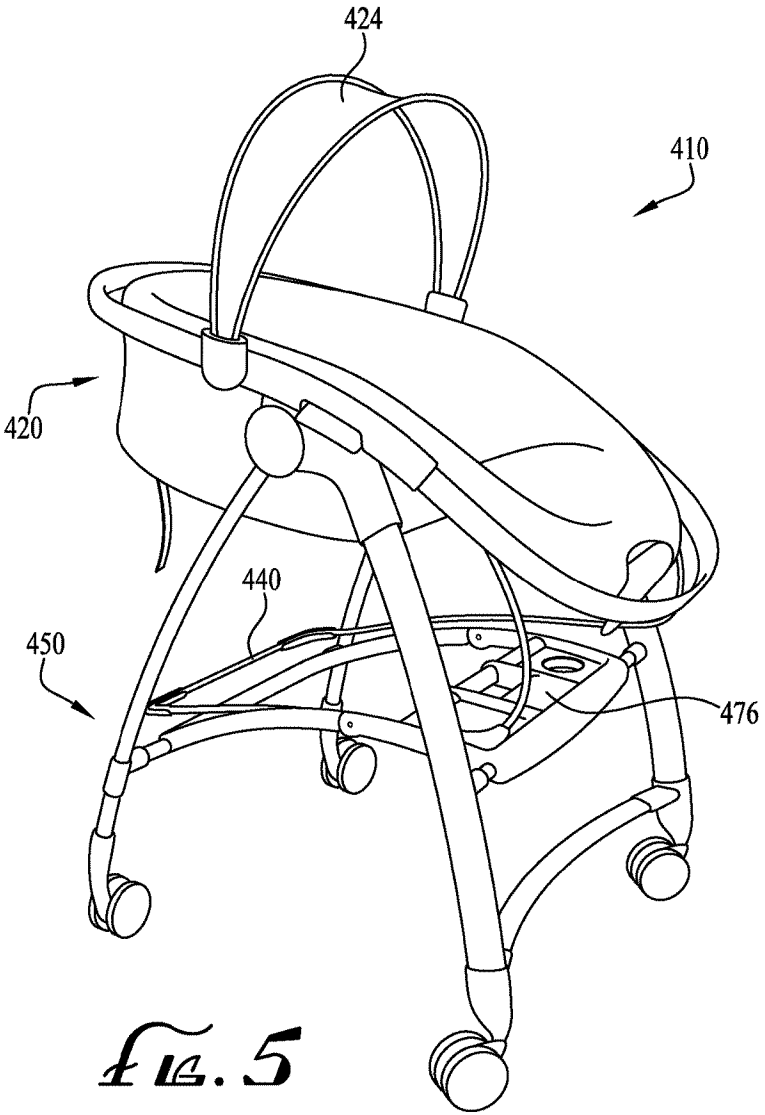
FIG. 5 is a perspective view of a support device according to another example embodiment of the invention.

FIGS. 5-10 show a support device 410 according to another example embodiment of the invention. The support device 410 includes a support component such as a seat 420 removably mounted to a support base frame 450. The seat portion 420 optionally comprises an internal support structure and fabric or other exterior soft goods forming a receiving area for positioning an infant or child. The seat 420 includes a handle 422 or gripping portion extending around all or a substantial portion of the periphery of the seat. In alternate embodiments, the handle extends in different positions from the front, rear, sides, and/or other parts of the seat 420, to facilitate a caregiver pushing, pulling, carrying, or otherwise moving the device 410 from room to room. The handle can also be used to aid a caregiver in adjusting the orientation of the seat or for manually imparting a bouncing or jiggling motion to the seat. The handle 422 is optionally repositionable to raise or lower its height. The seat 420 optionally includes a canopy or toy bar 424 extending over the receiving area of the seat, a feeding tray, a storage compartment, one or more seat belts or harnesses, and/or other accessories. An incline-recline positional adjustment mechanism 426 is optionally provided on the back section of the seat 420, as shown in FIG. 6, for example in the form of an adjustable positioning strap, one or more zippers, buckles, or other fasteners. Alternatively, the seat 420 is mounted to the frame 450 with an adjustable coupling allowing selective adjustment of the incline or recline of the seat.

Figure 7B:
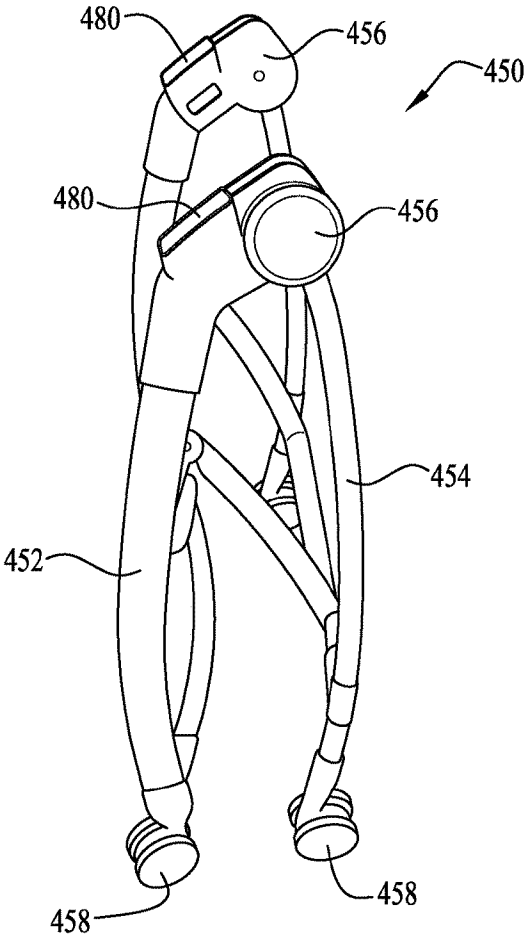
FIGS. 7A and 7B show the support frame of the support device of FIG. 5, with the seat portion removed, in open and folded configurations, respectively.
Figure 7A:
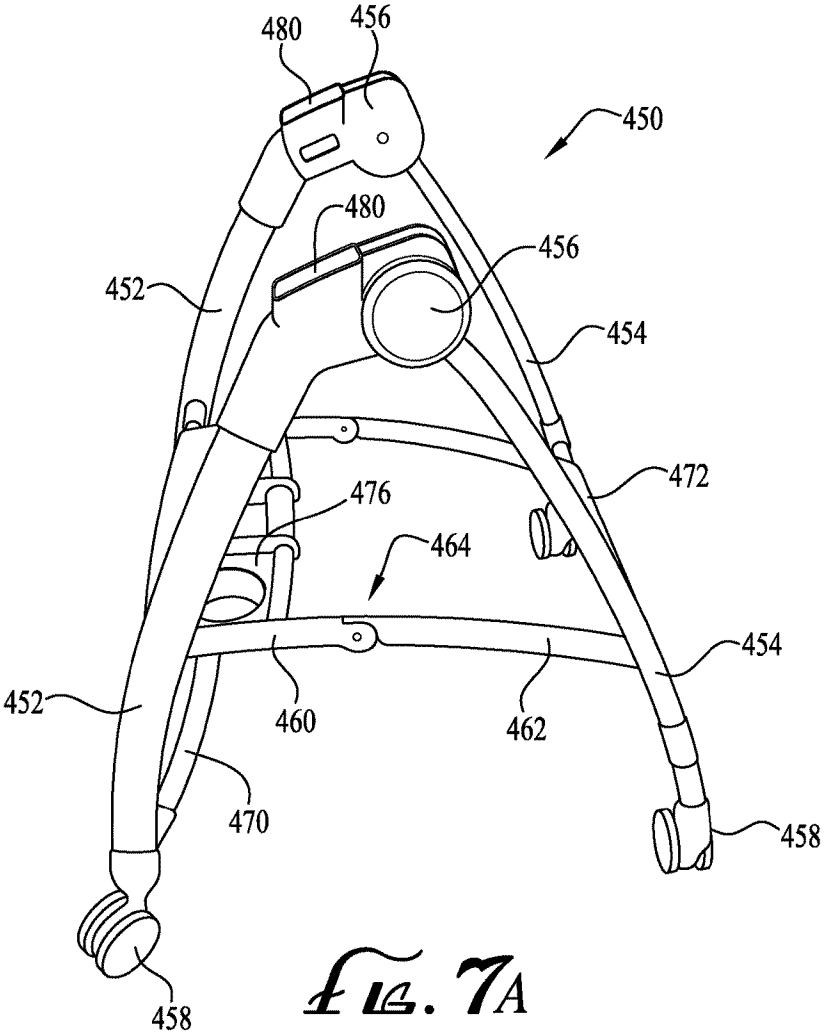
Figure 9:
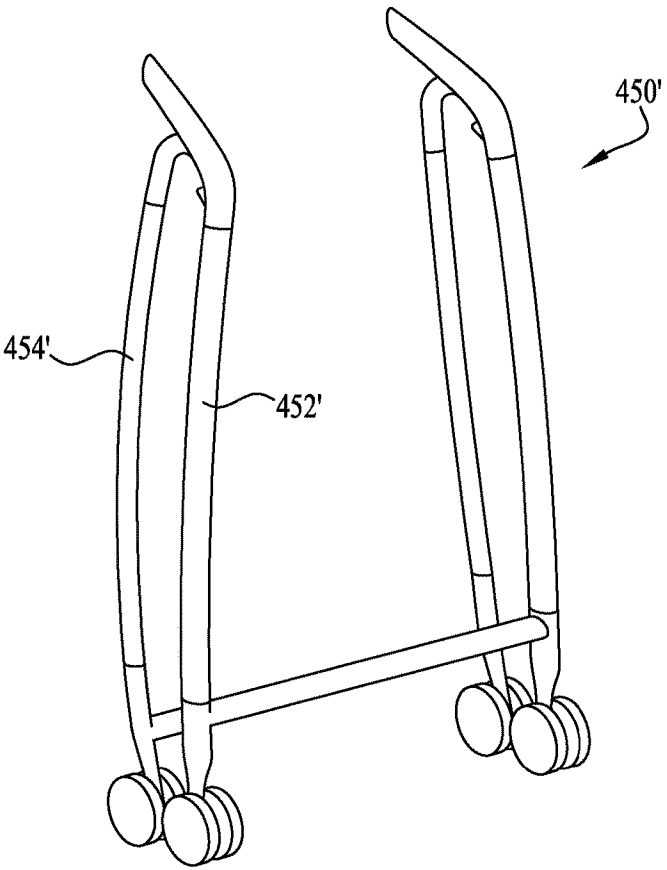
FIG. 9 is a perspective view of the support frame of the support device of FIG. 23, in a folded configuration.
Figure 8:
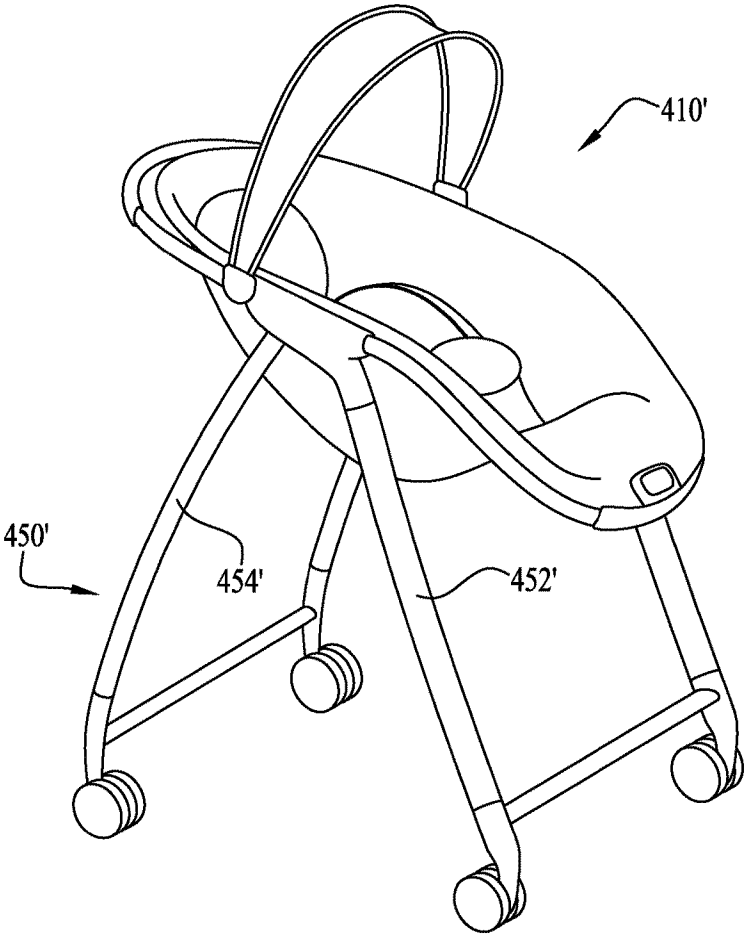
FIG. 8 is a perspective view of a support device according to another example embodiment of the invention.

FIGS. 7A and 7B show the support frame portion 450 in greater detail, with the seat portion 420 detached therefrom. The frame 450 is adapted to rest on a support surface such as a floor and support the seat 420, and optionally provide mobility for the support device. The frame 450 comprises a pair of front legs 452 and a pair of rear legs 454 pivotally connected to one another at upper ends thereof by a hinged hub 456. The front and rear legs 452, 454 optionally include roller wheels or casters 458 at lower ends thereof, to allow rolling mobility of the support device 410. One or more of the wheels 458 optionally include a locking mechanism to selectively allow or prevent rolling of the device 410, and/or a braking mechanism that engages in the event of accidental rolling. Optionally, a single-action braking mechanism allows locking or braking on all or a plurality of the wheels 458 upon operation of a single actuator. Hinged cross-braces comprising first and second segments 460, 462 interconnect between the front legs 452 and rear legs 454, with a hinged joint 464 allowing folding of the frame 450 between an open (FIG. 7A) position for use and a folded (FIG. 7B) position for storage or transport. Front and rear transverse cross-members 470, 472 extend between the front legs 452 and rear legs 454, respectively. An accessory storage platform 476, for example including one or more storage compartments, cup-holders and/or other accessories is optionally provided, for example pivotally connected to the front legs 452 and attached to the first segments 460 of the hinged cross-braces on each side of the frame 450. The hubs 456 optionally include receivers 480, latches or other connectors for releasable and detachable coupling of the seat 420 to the frame 450. The frame 450 is optionally configured for use independently of the seat 420, for example with one or more different infant or child support components or resting portions, such as seats, bassinets, sleepers, rockers, etc., that can be interchangeably mounted to the frame, and/or having seating or support portions built into the frame itself. The receivers 480 are optionally of a universal configuration, compatible with corresponding mounting members of multiple different types of seats or other support components or resting portions for child support devices. FIGS. 8 and 9 show an alternate embodiment of the support device 410', with a frame 450' that is foldable between an expanded configuration (FIG. 8) and a folded configuration (FIG. 9), and without a storage platform or lower cross-braces bridging between the front and rear legs 452', 454'.

The support component or seat 420 can be coupled directly to the support frame 450 or can be indirectly coupled to the frame by one or more intermediate couplings, linkages or connection components. Further, the seat 420 can be coupled to the support frame 450 by way of one or more resilient members, such as springs or flexible or compliant wires that allow the seat to bounce or jiggle with respect to the frame. This bouncing motion can be soothing to children resting in the seat 420, and the resilient suspension can soften the jarring effect of any bumps as the support device 410 is wheeled from place to place. In alternate embodiments, the movement of the seat 420 relative to the frame 450 can be in the form of bouncing, rocking, swinging, swaying, jiggling, vibration, or other form of motion, and may include a lock/release mechanism to allow the user to selectively permit motion or fix the seat in position relative to the frame. The movement of the seat 420 can be manually provided by an adult caregiver, or can be automatically generated, as by an electric motor or magnetic drive. Optionally, a locking mechanism can be provided for selectively allowing or prohibiting bouncing or other motion of the seat relative to the frame. The locking mechanism can be configured to automatically engage when the seat is oriented in an inclined orientation. Alternatively, the locking mechanism can be configured to automatically engage when the seat is oriented in a reclined orientation, or the locking mechanism can be selectively engageable by a caregiver. In example embodiments, the seat 420 is optionally removable from the frame 450 and usable independently of the frame. In alternate embodiments, the seat 420 is permanently or semi-permanently attached to the frame 450.

Figure 10:
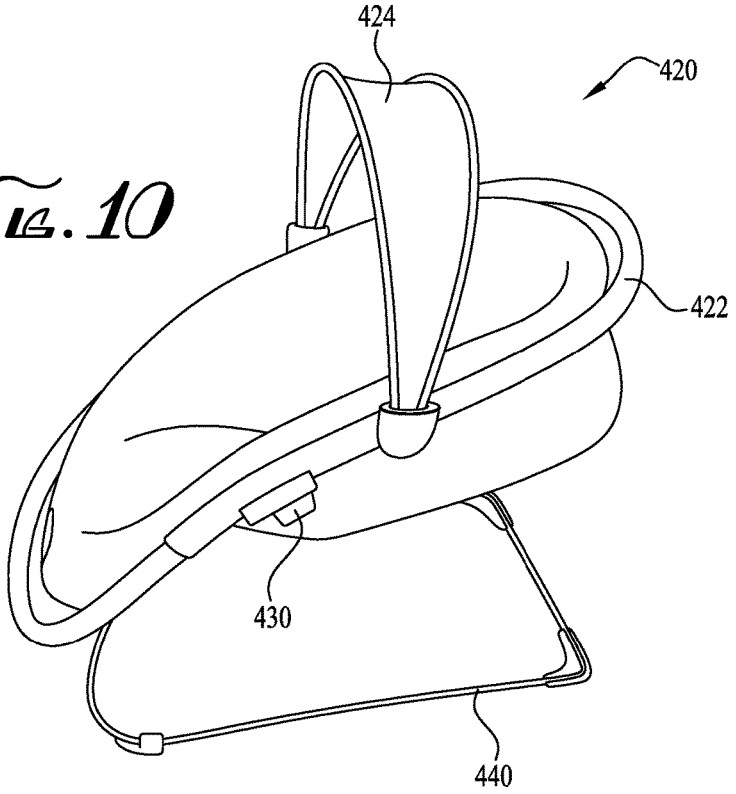
FIG. 10 shows the seat portion of the support device of FIG. 5, used independently of the support frame, according to an example embodiment of the invention.
Figure 11:
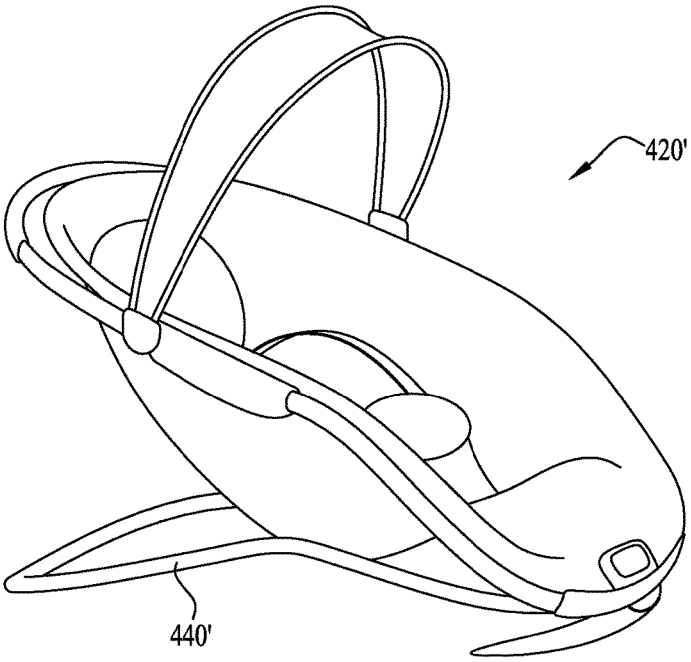
FIG. 11 shows a seat portion of a support device according to another example embodiment of the invention, used independently of the support frame.

The support component or seat 420 can comprise a dual-mode child-containment device, detachably mounted to the frame 450, and selectively reconfigurable by the user between a first mode of use mounted to the frame (FIG. 5) and a second mode of use independent of the frame (FIG. 10). For example, in the depicted embodiment, the seat 420 comprises mounting flanges 430 on each side for releasable attachment in the receivers 480 of the frame, to mount the seat to the frame in the first mode of use. The seat 420 also includes a support base 440 for supporting the seat on a floor or other support surface independent of the frame 450. The seat support base 440 optionally allows a user to impart motion to the seat 420 in its independent mode of use. For example, the seat support base 440 can include resilient members such as flexible spring arms, curved rockers, a resilient bouncer mechanism, and/or an electrical vibration unit. In this manner, the seat 420 can function independently of the frame as a bouncer, a rocker, an infant support seat, or other infant or child support device. FIG. 11 shows an alternate embodiment of a seat 420' having a pivotally mounted or resilient support base 440', for example providing for spring-like bouncing movement of the seat when positioned upon a floor or other support surface.

In example embodiments, the seat 420 and frame 450 are configured to provide the support device 410 with height, width, length, seating angle and other geometric size, dimensional ratios, and/or shape characteristics as described above. In alternate embodiments, the frame comprises height-adjustment features, for example telescoping legs and/or a repositionable coupling between the frame and the seat, to accommodate the support device 410 to a variety of applications, such as for example, to generally match sofa-height, table height, counter-height, bed-height, or other positions of an adult caregiver, to position a child at approximately corresponding eye level with the caregiver. The size and geometrical configuration of the support device 410 preferably provides a high degree of stability in forward, rearward and sideward directions, while also maintaining ease of mobility and interactivity between a child in the support device and an adult caregiver. In example embodiments, the support device 410 resists tipping over with: a child or simulated child load weight of about 7.5 pounds (3.4 kg)-17.5 pounds (8.0 kg) in the seating area, upon application of a static downward vertical force of about 21 lbf (93 N) within about 5 seconds, and maintained for another about 60 seconds, when positioned on a surface inclined at about 20° in the most unfavorable sideward or rearward position, and maintained for about 1 minute; and/or with a 23 lbf (10.35 kg) static vertical load on the handle, and a horizontal force of about 5 lb. (22 N) applied at the same point on the handle, and the vertical and horizontal forces maintained for about 10 seconds; and/or positioned on a surface inclined at about 20° from horizontal, applying a 23 lb. (10.4 kg) static vertical load along an upper side surface, and applying a horizontal force of about 5 lbf (22 N) within 5 seconds at the same location as the vertical load, and maintaining the vertical and horizontal loads for about 10 seconds.

Additionally, a feeding tray, cup holder, or another container or compartment for holding accessories can optionally be mounted to the seat and/or the support frame. The container or compartment can be detached from the child support device for cleaning or for relocation to another position on the support device. Additionally, example embodiments of the support device can include user input controls that allow the caregiver to control various features of the support device, such as a vibration unit, volume and music controls, an electronic toy mobile, etc.

Figure 12A:
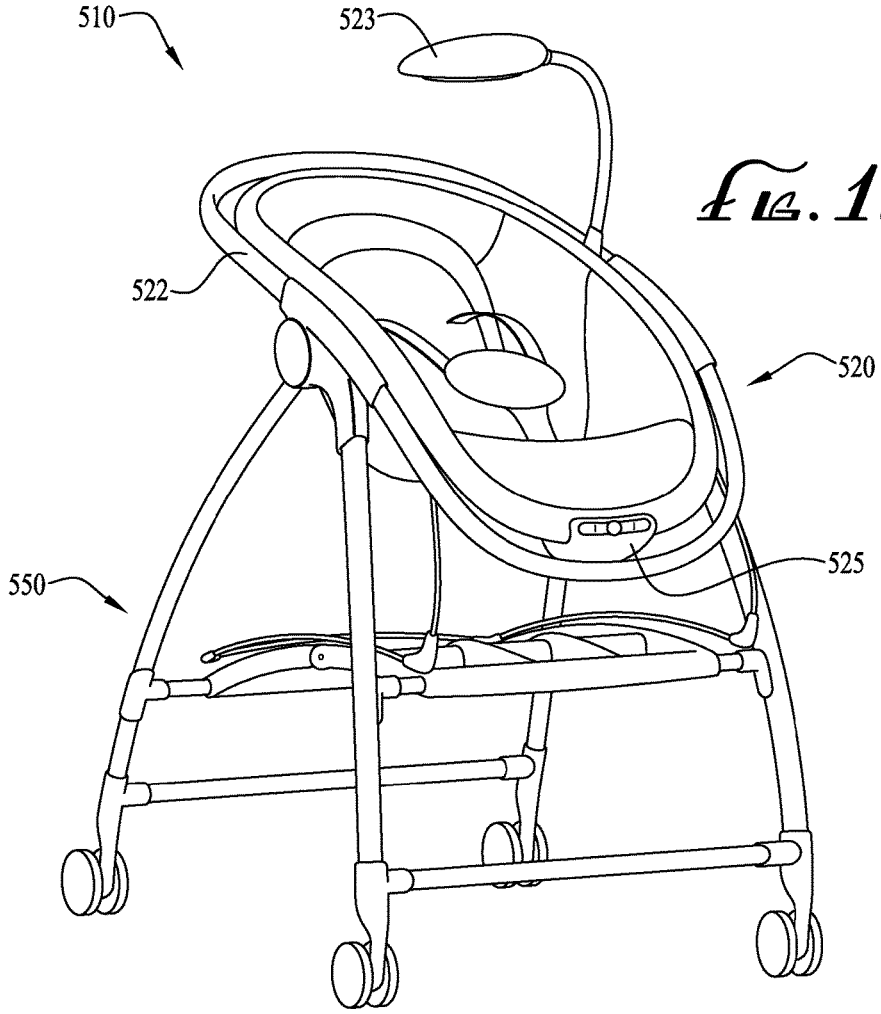
FIG. 12A is a perspective view of a support device according to another example embodiment of the invention.
Figure 12B:
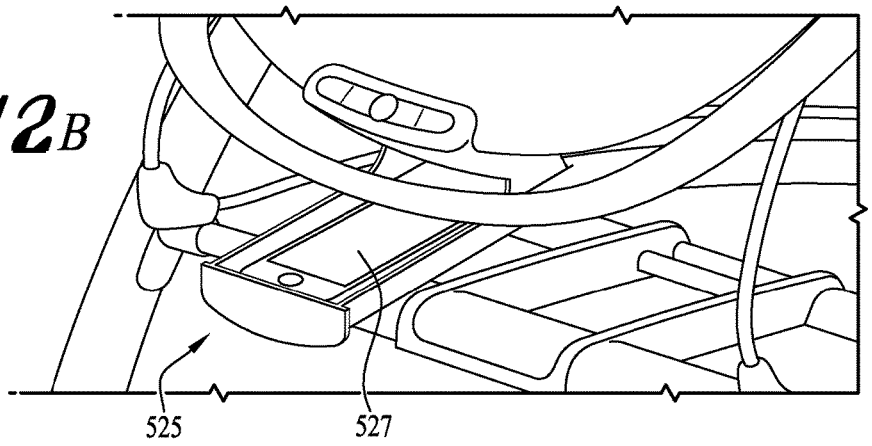
FIG. 12B is a perspective view of a slide-out storage compartment of a support device according to an example embodiment of the invention, with an electronic device held therein.

FIGS. 12A and 12B show additional features of a child support device 510, according to another example embodiment of the invention. The support device 510 generally comprises a seat 520 and frame 550 in substantially similar form to that described above. The seat 520 further comprises an entertainer 523 mounted to its handle 522, and a storage compartment 525 beneath the receiving area for holding accessories such as for example a cell phone or other electronic device 527, which may be used to play music, show videos, control motion of the seat, control the operation of the light 523, and/or provide other functions. The entertainer 523 can be a toy bar, mobile, projector, audio unit, light up bar, etc. Optionally, the storage compartment 525 comprises a docking station or other electronic connection or communication means for delivering and receiving electronic signals from the electronic device 527 and/or for charging the electronic device.

Figure 13:
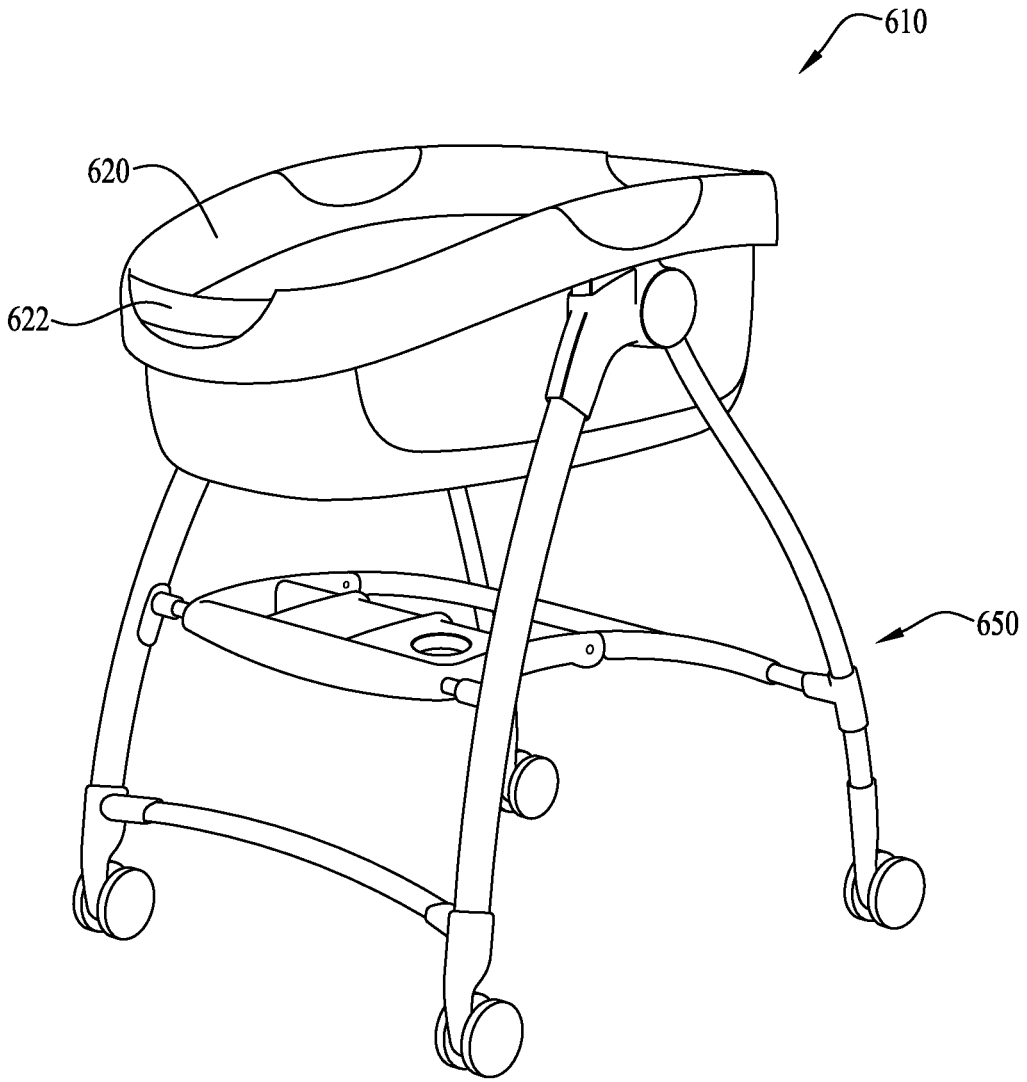
FIG. 13 is a perspective view of a support device having a bassinet interchangeably mounted in place of the seat, on the support frame of the support device of FIG. 10.

FIG. 13 shows another example embodiment of a child support device 610. In this embodiment, the resting portion or support component comprises a bassinet or sleeper 620 mounted to the frame 650 instead of a seat. The bassinet 620 can be detachably mounted to the frame, for example in an interchangeable manner with one or more other child or infant resting portions or support components such as a seat, a rocker, asleep unit, or other device. In example embodiments, the frame 650 includes a universal first mounting element compatible with a corresponding cooperative universal second mounting element of the bassinet 620 or other support component, for releasable coupling and detachable mounting of the support unit to the frame. In alternate embodiments, the bassinet 620 or other support unit is permanently or semi-permanently attached to the frame 650. The bassinet 620 optionally includes a handle or handgrip 622 extending around all or a substantial portion of the child receiving area within the bassinet, with one or more cutout portions of the fabric soft-goods allowing access for a user to grip the handle.

Figure 14:
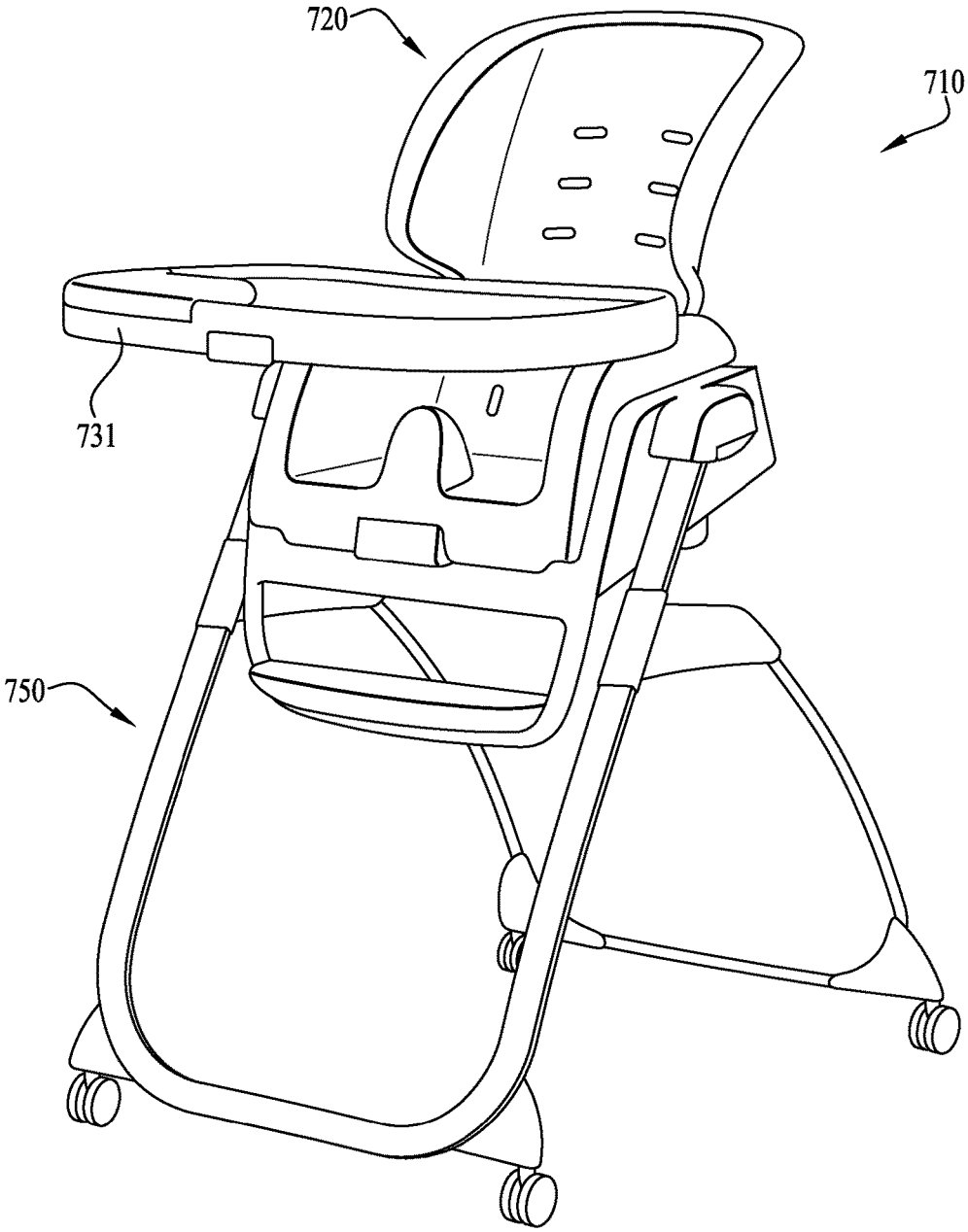
FIG. 14 is a perspective view of a support device according to another example embodiment of the invention.
Figure 15A:
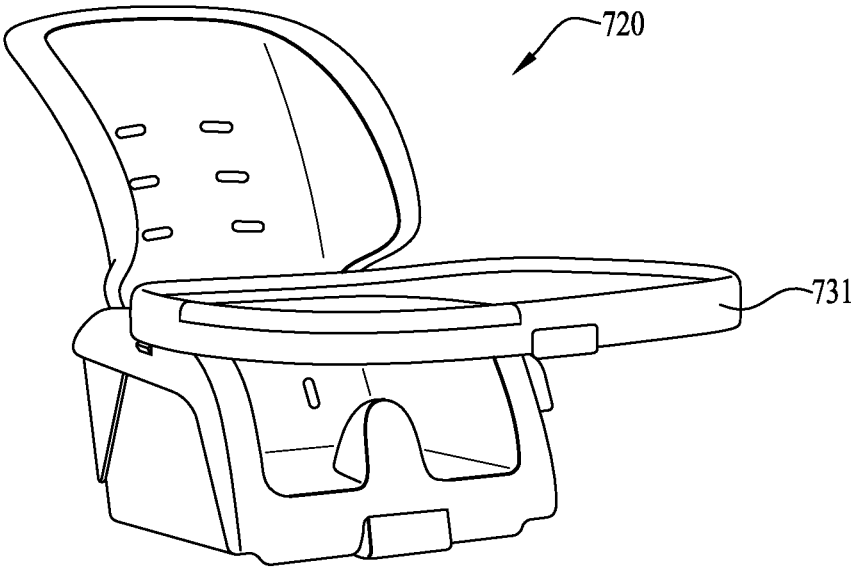
FIGS. 15A and 15B separately show the seat portion and the support frame portion, respectively, of the support device of FIG. 12.
Figure 15B:
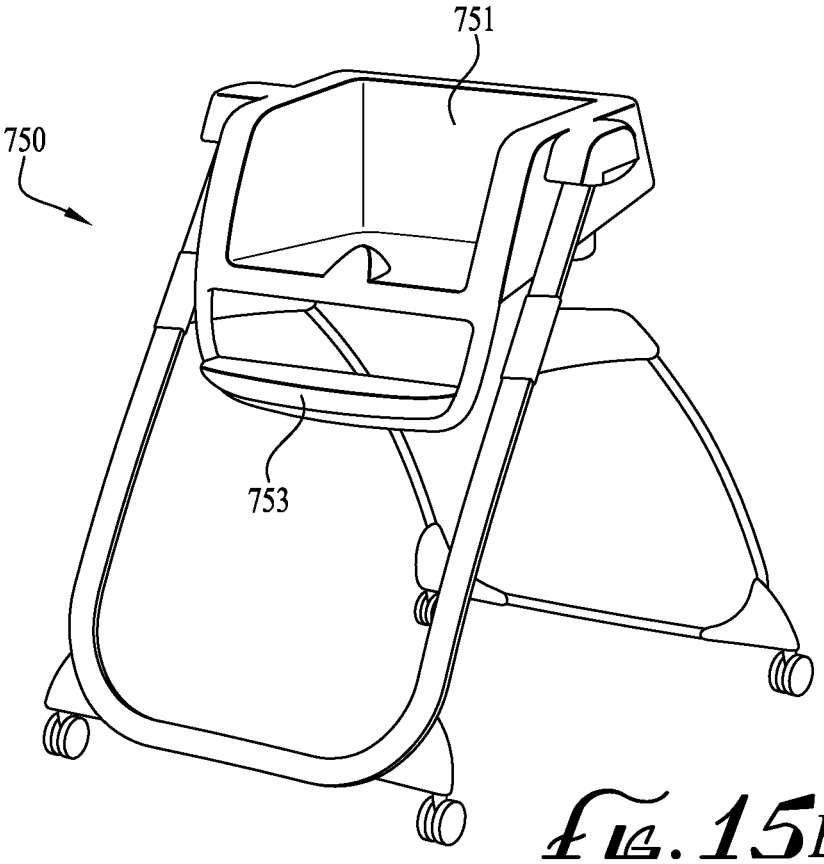
Figure 16:
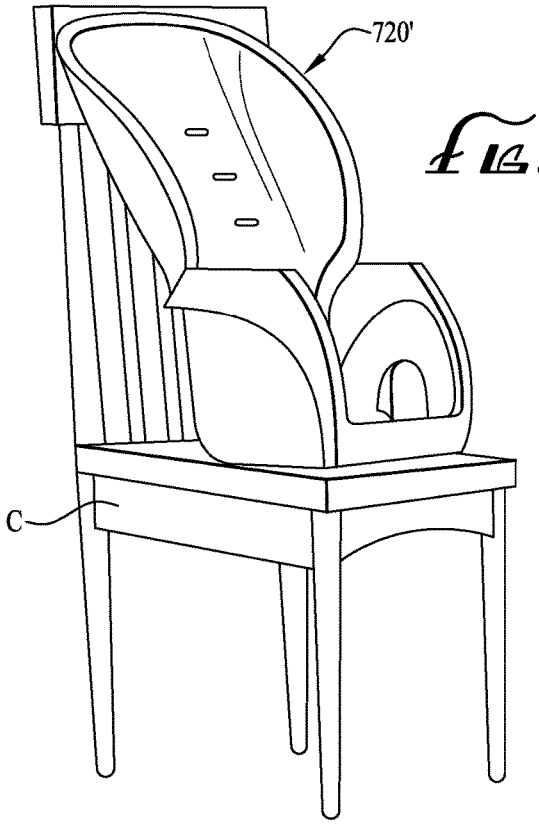
FIG. 16 is a perspective view of a seat portion of a support device according to an example embodiment of the invention, detached from the support frame and positioned on a chair.

FIGS. 14, 15A and 15B show another example embodiment of a child support device 710. The support device 710 includes a seat 720 and a frame 750. The seat 720 includes a feeding tray 731, which is optionally removable or repositionable for access to place a child in the seat. The seat 720 is optionally removable from the frame, as shown in FIGS. 15A and 15B, allowing the seat to be used independently of the frame. The frame 750 optionally comprises an integral second seating portion 751, allowing the frame to be used as an independent booster seat without the seat 720, providing a seating height somewhat lower than the seating height with the seat 720 installed. A footrest 753 is optionally provided, positioned for use with or without the seat 720 installed on the frame 750. FIG. 16 shows an alternate embodiment of a seat 720' used independently of its frame, and supported on a chair C.

Figure 17:
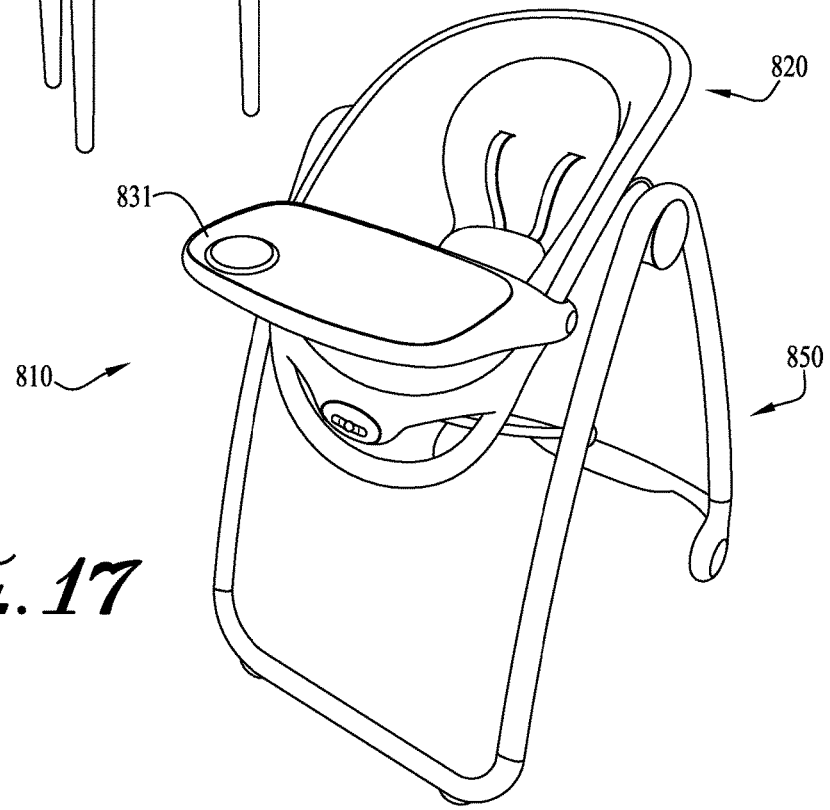
FIG. 17 is a perspective view of a support device incorporating a feeding or accessory tray according to another example embodiment of the invention.

FIGS. 17, 18 and 19 show additional embodiments of child support devices 810, 910 and 1010, respectively, having several different forms of feeding trays according to example forms of the present invention. In the embodiment of FIG. 17, the support device 810 comprises a seat 820 mounted to a frame 850, and a feeding tray 831 detachably coupled to the seat. In example embodiments the seat 820 is movably coupled to the frame 850, for example by a pivotal coupling or rocking hub, to allow for reciprocating motion with respect to the frame, for example providing a rocking, swinging, swaying, gliding or other range of motion. The seat is optionally detachable from the frame, and the frame is optionally foldable, for example having substantially similar seat and/or frame configurations as described in greater detail above. In the embodiment of FIG. 18, the support device 910 comprises a seat 920 mounted to a frame 950, and a feeding tray 931 mounted to the seat or frame in a horizontally pivotal configuration, allowing the tray to pivot between a first configuration in front of the seat for feeding and a second configuration to the side of the seat for access in placing and removing the child to and from the seat. The tray 931 can include one or more surface compartments, which are optionally removable or which receive removable dishwasher-safe liners for ease of cleaning. In the embodiment of FIG. 19, the support device 1010 comprises a seat 1020 mounted to a frame 1050, and a feeding tray 1031 mounted to the seat or frame in a vertically pivotal configuration, allowing the tray to pivot between a first configuration in front of the seat for feeding and a second configuration away from the seat for access in placing and removing the child to and from the seat.

Figure 20:
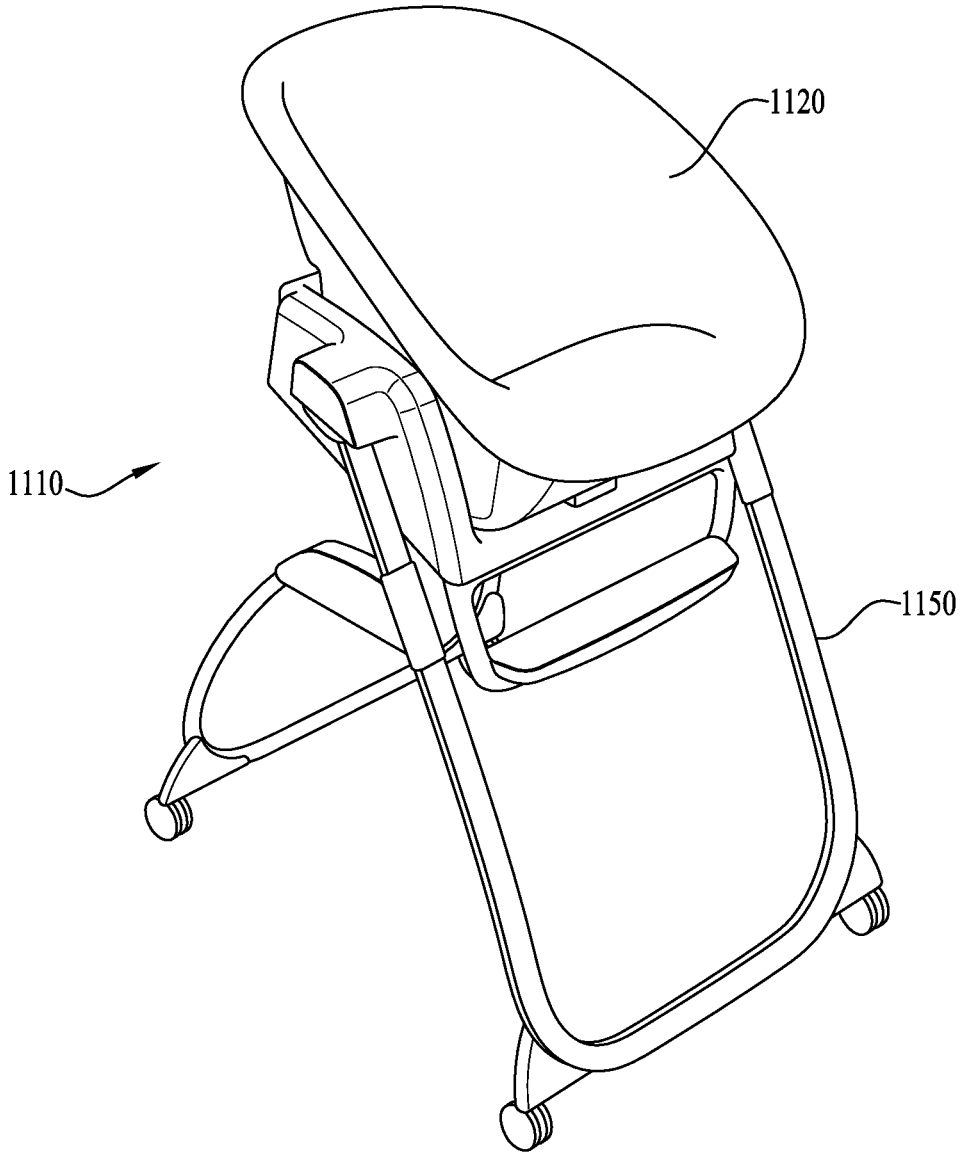
FIG. 20 is a perspective view of a support device according to another example embodiment of the invention.

FIG. 20 shows another example embodiment of a child support device 1110, having a seat portion 1120 removably mounted on a frame portion 1150. The frame optionally allows adjustment of the seating height, and the seat is optionally movable relative to the frame, for example to allow for adjustment of the incline-recline position of the seat, and/or to impart a rocking, swinging, swaying, bouncing, jiggling, vibrational or other movement.

Figure 21A:
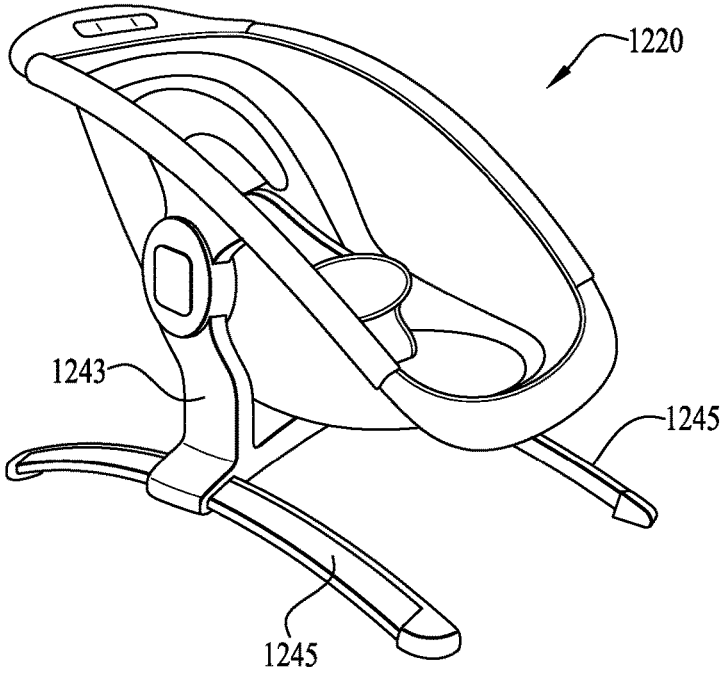
FIGS. 21A and 21B are perspective views of a seat portion of a support device according to an example embodiment of the invention, detached from the support frame and with base portions of the seat alternately positioned in fixed and rocker configurations, respectively.
Figure 21B:
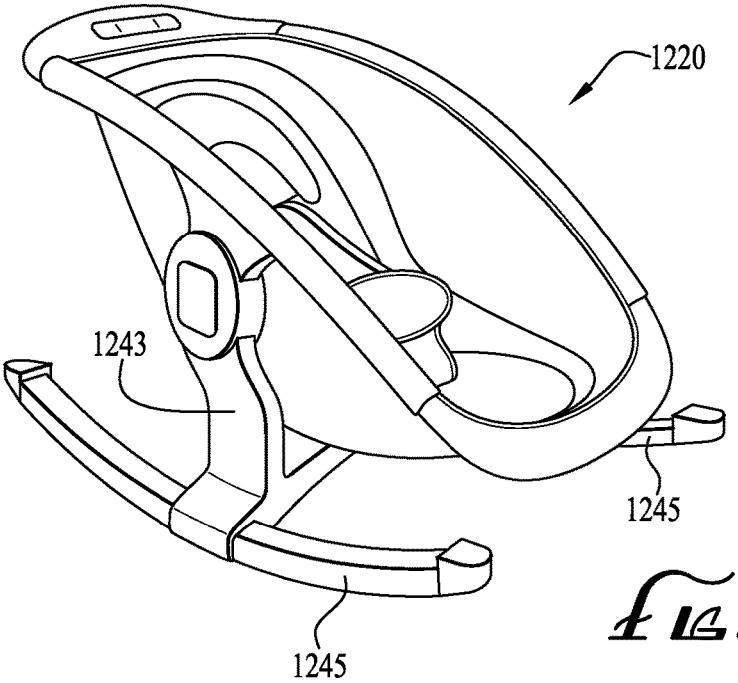

FIGS. 21A and 21B show a reconfigurable seat 1220, according to another example embodiment of the invention. The seat 1220 can be configured for mounting to a support frame in similar fashion as described above in a first mode of operation, and for use in one or more additional modes of operation independent of the frame. For example, FIG. 21A shows the seat 1220 in a fixed position mode of operation independent of the frame, and FIG. 21B shows the seat 1220 in a rocking mode of operation independent of the frame. The seat 1220 includes a base 1243 having receivers for engaging a pair of repositionable arcuate support members 1245. In the fixed position mode (FIG. 21A) the arcuate support members 1245 are engaged in the receivers of the base 1243 with their concave sides oriented downwardly, so that ends of the arcuate support members rest on the floor or other support surface and retain the seat 1220 in a stable, fixed position. In the rocking mode (FIG. 21B) the arcuate support members 1245 are engaged in the receivers of the base 1243 with their convex sides oriented downwardly, so arcuate support members can rock on the floor or other support surface.

Figure 22:
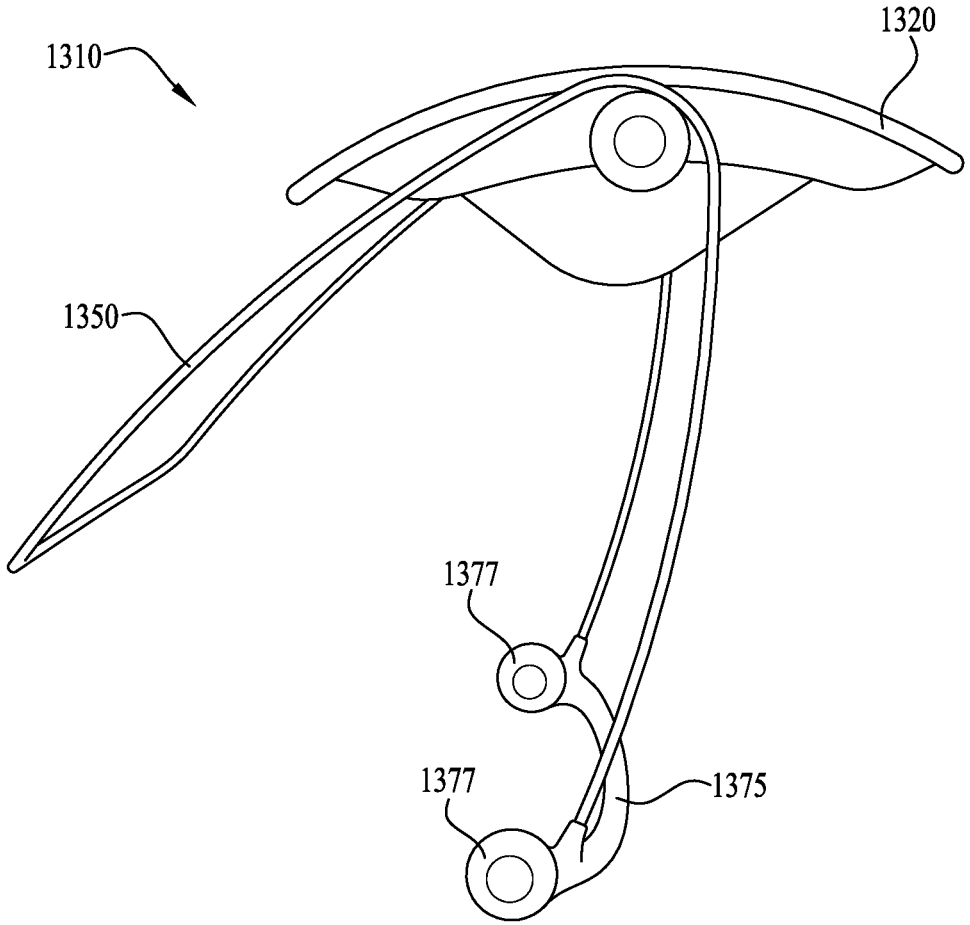
FIG. 22 is a perspective view of a support device having a tilt-positionable roller base, according to another example embodiment of the invention.
Figure 23B:
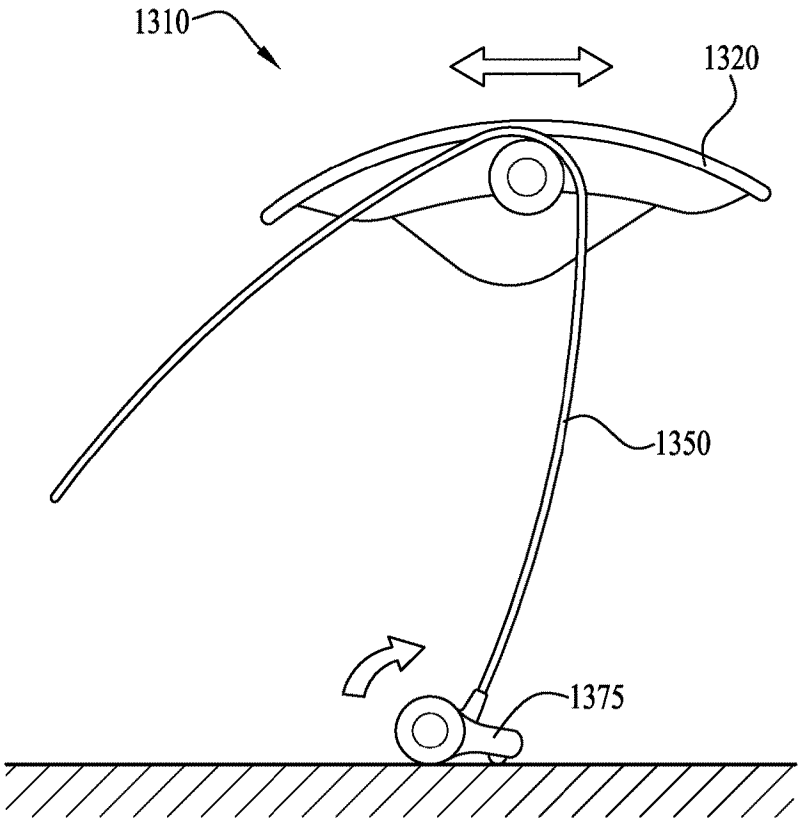
FIGS. 23A and 23B are side views of the support device of FIG. 20, in an untilted fixed position and a tilted rolling position, respectively.
Figure 23A:
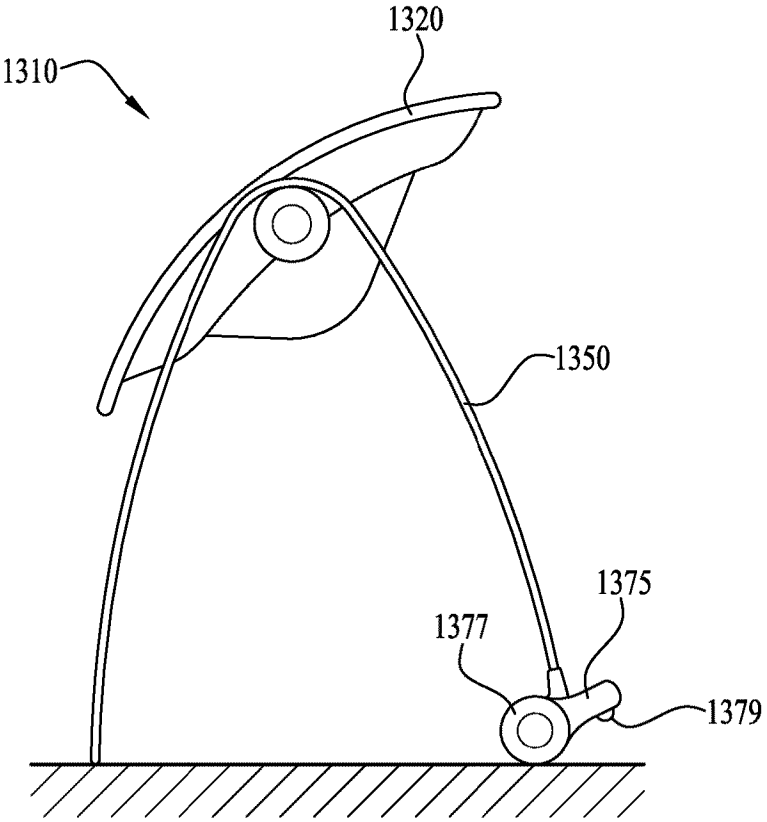

FIGS. 22, 23A and 23B show another example embodiment of a child support device 1310, having a seat 1320 mounted to a frame 1350. A cross member base or trolley 1375 extends between the lower ends of the rear legs and aids in preventing the support device from tipping over when it is tilted onto its rear legs for rolling movement. The cross member or trolley 1375 can also include one or more wheels, for providing mobility to the support device 1310. For example, in the depicted embodiment, the cross member or trolley 1375 comprises an arcuate member having a first pair of larger wheels 1377 at its forward distal ends, and a second pair of smaller wheels 1379 on the lower surface of its medial portion. The medial portion of the cross member or trolley 1375 is angularly offset, such that the smaller wheels 1379 are raised off of the ground when the support device 1310 is positioned for use with its front legs on the ground (FIG. 23A), and contact of the front legs on the ground prevents rolling movement of the support device. When the support device 1310 is tipped rearwardly with its front legs raised off the ground (FIG. 23B), the smaller wheels 1379 and the larger wheels 1377 provide a stable rolling platform for moving the support device. The horizontal offset between the smaller wheels 1379 and the larger wheels 1377 resists tipping of the support device during rolling movement.

Figure 24:
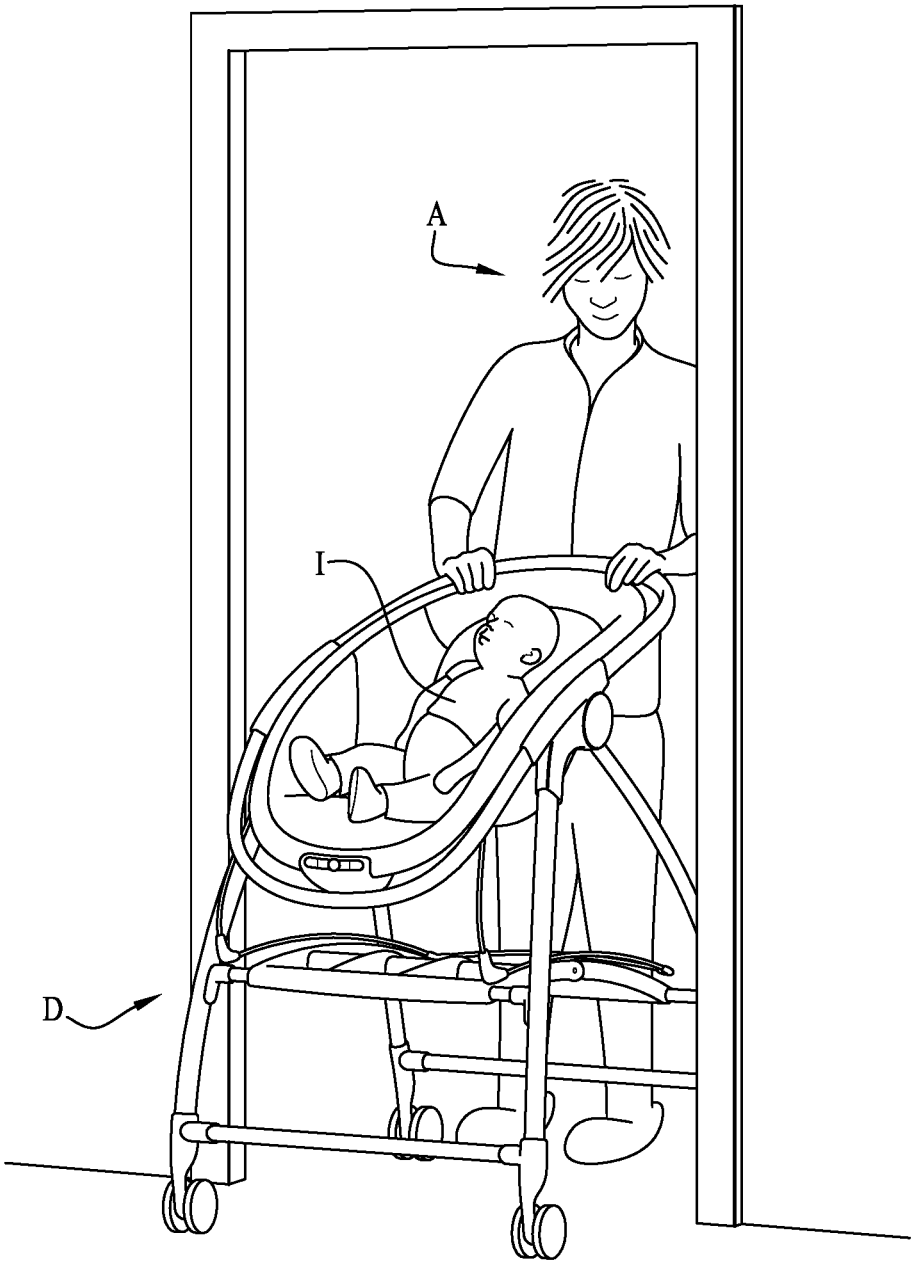
FIG. 24 shows a support device according to an example embodiment of the invention being moved through a doorway.

In an example manner of use, as shown in FIG. 24, an adult caregiver A can easily move a support device D according to any of the embodiments described herein, with a child or infant I resting in the support device. The support device D is particularly configured for ease of mobility, stability, and accessibility. For example, the support device D can be rolled from room to room within various living quarters through standard doorways.

While the invention has been described with reference to preferred and example embodiments, it will be understood by those skilled in the art that a variety of modifications, additions and deletions are within the scope of the invention, as defined by the following claims.

What is claimed is:

1. A child support device comprising:

a folding frame comprising front legs and rear legs, the front and rear legs pivotally coupled to one another to move between a folded configuration and an unfolded configuration;

a first support component configured for detachably mounting to the folding frame and comprising a first receiving area for receiving and supporting a child in a first support position, wherein the folding frame supports the first support component with the receiving area positioned at a height of about 21" to about 36" above a support surface; and a second support component different from the first support component, and configured for detachably mounting to the folding frame, the second support component comprising a second receiving area for receiving and supporting a child in a second support position different from the first support position, whereby the first and second support components are used interchangeably in connection with the folding frame.

2. The child support device of claim 1, wherein the frame maintains the first support component with the first receiving area at a height of about 26"-32".

3. The child support device of claim 1, wherein the frame maintains the first support component with the first receiving area at a height of about 29".

4. The child support device of claim 1, wherein the height of the first support component is adjustable.

5. The child support device of claim 1, wherein the frame comprises wheels for mobility.

6. The child support device of claim 5, wherein the frame comprises a trolley having at least one first wheel horizontally and angularly offset relative to at least one second wheel.

7. The child support device of claim 1, wherein the first support component is a dual-mode support, usable in a first mode of use mounted to the frame, and a second mode of use independent of the frame.

8. The child support device of claim 7, wherein the dual-mode support has a support base comprising at least one resilient member for allowing motion in the second mode of use independent of the frame.

9. The child support device of claim 7, wherein the dual-mode support has a base with receivers for engaging repositionable arcuate members, repositionable between a fixed position mode and a rocking mode in the second mode of use independent of the frame.

10. The child support device of claim 1, wherein the first support component comprises a seat.

11. The child support device of claim 10, wherein the second support component comprises a bassinet.

12. The child support device of claim 1, wherein the gripping handle extends substantially entirely around a periphery of the support component.

13. The child support device of claim 1, wherein the folding frame comprises at least one hinged cross-brace extending between the front and rear legs.

14. The child support device of claim 1, wherein the folding frame comprises an accessory storage platform extending between the front legs.

15. The child support device of claim 1, wherein at least one of the first and second support components comprises a storage compartment.

16. The child support device of claim 15, wherein the storage compartment comprises a docking station for an electronic device.

17. The child support device of claim 1, wherein the frame comprises a secondary seating surface accessible when the first and second support components are both removed from the frame.

18. The child support device of claim 1, wherein the first support component comprises a feeding tray.

19. The child support device of claim 18, wherein the feeding tray is pivotally mounted to the support device.

20. A child support device comprising:

a frame comprising front legs and rear legs, and a hub connecting the front and rear legs, the hub comprising a first coupling element; and a first support component having a second coupling element releasably engageable with the first coupling element for detachably mounting the first support component to the frame, wherein the frame supports the first support component at a height of about 21" to about 36" above a support surface; and a second support component different from the first support component, and having a third coupling element releasably engageable with the first coupling element for detachably mounting the second support component to the frame, whereby the first and second support components are used interchangeably in connection with the folding frame.

21. The child support device of claim 20, wherein the height of the first support component is adjustable.

22. The child support device of claim 20, wherein the frame comprises wheels for mobility.

23. The child support device of claim 20, wherein the hub hingedly connects upper ends of the front and rear legs.

24. The child support device of claim 20, wherein at least one of the first and second support components is a dual-mode support, usable in a first mode of use mounted to the frame, and in a second mode of use independent of the frame.

25. A child support device comprising a support frame, a first child-supporting seat releasably and movably coupled to the support frame to allow for reciprocating motion of the first child-supporting seat with respect to the support frame; and a second child-supporting component different from the first child-supporting seat and configured to be releasably coupled to the support frame, the first child-supporting seat and the second child supporting component being compatible for interchangeable use in connection with the support frame;

wherein the support frame is foldable.

26. The child support device of claim 25, wherein the first child-supporting seat is a dual-mode support, usable in a first mode of use mounted to the support frame, and usable in a second mode of use independent of the support frame.

27. A child support device comprising a support frame, a first child-supporting seat releasably and movably coupled to the support frame to allow for reciprocating motion of the first child-supporting seat with respect to the support frame; and a second child-supporting component different from the first child-supporting seat and configured to be releasably coupled to the support frame, the first child-supporting seat and the second child supporting component being compatible for interchangeable use in connection with the support frame;

wherein the support frame supports the first child-supporting seat at a height of about 21" to about 36" above a support surface; and wherein the height of the first child-supporting seat is adjustable.

28. A child support device comprising a support frame, a first child-supporting seat releasably and movably coupled to the support frame to allow for reciprocating motion of the first child-supporting seat with respect to the support frame; and a second child-supporting component different from the first child-supporting seat and configured to be releasably coupled to the support frame, the first child-supporting seat and the second child supporting component being compatible for interchangeable use in connection with the support frame;

wherein the support frame comprises wheels for mobility.

* * * * *